US010789862B2

(12) United States Patent
Culhane

(10) Patent No.: US 10,789,862 B2
(45) Date of Patent: Sep. 29, 2020

(54) TILE HOLDER

(71) Applicant: Jeffrey James Culhane, McKinney, TX (US)

(72) Inventor: Jeffrey James Culhane, McKinney, TX (US)

( * ) Notice: Subject to any disclaimer, the term of this patent is extended or adjusted under 35 U.S.C. 154(b) by 0 days.

(21) Appl. No.: 16/283,126

(22) Filed: Feb. 22, 2019

(65) Prior Publication Data

US 2019/0266924 A1 Aug. 29, 2019

Related U.S. Application Data

(60) Provisional application No. 62/634,430, filed on Feb. 23, 2018.

(51) Int. Cl.

| | |
|---|---|
| ***G09F 3/20*** | (2006.01) |
| ***G09F 7/08*** | (2006.01) |
| ***G09F 7/10*** | (2006.01) |

(52) U.S. Cl.

CPC ..... *G09F 3/202* (2013.01); *G09F 3/201* (2013.01); *G09F 7/08* (2013.01); *G09F 7/10* (2013.01); *G09F 3/204* (2013.01)

(58) Field of Classification Search

CPC . G09F 3/202; G09F 3/201; G09F 7/08; G09F 7/10; G09F 3/204

See application file for complete search history.

(56) References Cited

U.S. PATENT DOCUMENTS 833,247 A * 10/1906 Sampson ..... G09F 7/08 40/618
1,537,321 A * 5/1925 Mayer ..... G09F 7/08 40/618
1,709,202 A * 4/1929 Beldin ..... G09F 13/04 40/564
1,727,079 A * 9/1929 Poirier ..... G09F 3/202 40/5
1,785,145 A * 12/1930 Roll ..... G09F 7/08 40/618
2,669,964 A 2/1954 Wexler
2,732,644 A * 1/1956 Graf ..... G09F 7/08 40/653
4,096,603 A 11/1978 Klaus (Continued)

FOREIGN PATENT DOCUMENTS

CN 106724404 A 5/2017
DE 3707411 C1 8/1988

(Continued)

OTHER PUBLICATIONS

"Merchandising super grip wood shelf display trak". Staples, https://www.staples.ca/en/FFR-Merchandising-SuperGrip-Wood-Shelf-Display-Trak-1-25-H-x-2-5-L-30-Pack-1813962700/product_2738309_1-CA_1_20001. Accessed on Apr. 30, 2019. (3 pages).

(Continued)

*Primary Examiner* — Gary C Hoge

(74) *Attorney, Agent, or Firm* — Nixon Peabody LLP

(57) ABSTRACT

A tile holder that can be attached to or integrated with a storage device. The tile holder may hold, for example, alphabet tiles. The tile holder may be used in settings where labelling is required. The tile holder may be constructed from a rigid material, such as wood, metal or a semi-flexible or flexible material, such as rubber or plastic. The tile holder may be a face plate that optionally couples to a space block.

6 Claims, 29 Drawing Sheets

(56) References Cited

U.S. PATENT DOCUMENTS

| | | | | |
|---|---|---|---|---|
| 4,149,333 | A | 4/1979 | Garfinkle | |
| 4,775,058 | A | 10/1988 | Yatsko | |
| 4,848,017 | A * | 7/1989 | Bailey | G09F 7/10 40/576 |
| 5,408,773 | A * | 4/1995 | Hwang | G09F 13/04 40/547 |
| 5,511,331 | A * | 4/1996 | Morosini | G09F 3/04 40/316 |
| 5,890,306 | A * | 4/1999 | Smith | G09F 13/04 40/576 |
| 5,974,710 | A * | 11/1999 | Baldwin | G09F 13/04 40/564 |
| 6,584,716 | B2 * | 7/2003 | Paul | G09F 7/02 40/612 |
| 7,114,278 | B2 | 10/2006 | Marks et al. | |
| 7,574,822 | B1 | 8/2009 | Moore | |
| 8,381,423 | B2 | 2/2013 | Pierce et al. | |
| 9,574,371 | B2 | 2/2017 | English | |
| 2001/0013186 | A1 | 8/2001 | Malitas | |
| 2003/0052448 | A1 | 3/2003 | Bertrand | |
| 2005/0039367 | A1 | 2/2005 | Fox et al. | |
| 2014/0182176 | A1 | 7/2014 | Kaleugher | |

FOREIGN PATENT DOCUMENTS

| | | | |
|---|---|---|---|
| DE | 10305142 | A1 | 8/2003 |
| FR | 2857143 | A1 | 1/2005 |
| FR | 2876207 | A1 | 6/2005 |
| GB | 135754 | A | 12/1919 |
| GB | 548449 | | 10/1942 |
| GB | 2297789 | A | 8/1996 |
| GB | 2464353 | A | 4/2010 |
| WO | 03039302 | A1 | 5/2003 |

OTHER PUBLICATIONS

"2-5 inch snap lock label holders". Southern Imperial, http://www.southernimperial.com/2-5-inch-snap-lock-label-holders-212-dia-hooks-display-hook-p-2650.html. Accessed on Apr. 30, 2019. (4 pages).

"2 inch fast tag for adhesive labels display hook". Southern Impreial, http://www.southernimperial.com/2-inch-fast-tag-for-adhesive-labels-display-hook-p-2904.html. Accessed on Apr. 30, 2019. (3 pages).

"Open Wooden Shelf Holders Price". Amazon, https://www.amazon.com/Open-Wooden-Shelf-Holders-Price/dp/B01FUYZF32/ref=sr_1_3?ie=UTF8&qid=1511392364&sr=8-3&keywords=thick+display+label+shelf. Accessed on Apr. 30, 2019. (4 pages).

"Cupboard Label". Pinterest, https://www.pinterest.ca/pin/261771797071837999/. Accessed on Apr. 30, 2019. (2 pages).

"Cupboard Label". Pinterest, https://www.pinterest.ca/pin/719872940140819 25/. Accessed on Apr. 30, 2019. (2 pages).

"Azar Displays Vertical Horizontal Sign Holder", Staples, https://www.staples.ca/en/Azar-Displays-Vertical-Horizontal-Sign-Holder-104438/product_2716863_1-CA_1_20001. Accessed on Apr. 30, 2019. (3 pages).

"Brass Label Plate". Baum Kuchen, https://www.baum-kuchen.net/products/brass-label-plate. Accessed on Apr. 30, 2019. (2 pages).

"Door Labels Plate". http://pezcame.com/ZG9vciBzaWduYWdllG1hbGF5c2lh. Accessed on Apr. 30, 2019.

"Door Handle Advertising" http://cooladhandles.com/Entry.php. Accessed on Apr. 30, 2019. (4 pages).

* cited by examiner

TILE HOLDER

CROSS-REFERENCE TO RELATED APPLICATIONS

This application is a non-provisional patent application which claims the benefit of U.S. Provisional Application No. 62/634,430 filed on Feb. 23, 2018, with the same title.

FIELD OF THE INVENTION

The present invention relates to label displays. More specifically, the present invention relates to a tile holder that can be attached to or integrated with a storage device.

BACKGROUND OF THE INVENTION

Storage devices including shelves, cabinets, doors, jars, storage totes, backpacks and drawers often require their contents to be identified using labels. Such labelling may be required in settings including pantries, clothes closets, bathrooms, offices, laboratories, locker rooms, classrooms, bars, garages, warehouses, and kitchens.

Some types of labels known in the art include typed labels and handwritten labels.

Handwritten labels are usually hard to read. Furthermore, some handwritten labels are written using temporary ink products, such as dry erase technology, in which case their markings may fade or smudge over time. Other handwritten labels are written using permanent ink technologies, in which case they cannot be reused to label different contents.

Creating typed or printed labels requires specialized equipment. Additionally, typed or printed labels are usually permanent and therefore cannot be reused to label different contents.

Many types of labels known in the art are designed to simply label items. However, depending on the configuration of these labels, they may hinder the use of the labelled items. Furthermore, these labels may not be legible.

From the above, there is therefore a need to overcome the shortcomings of the prior art by providing a functional display label that is clearly legible and permanent but can also be reused or interchanged.

SUMMARY OF INVENTION

The present invention provides a tile holder that can be attached to or integrated with a storage device. The tile holder may be made of a rigid material, such as wood or metal, or a semi-flexible material, such as rubber or plastic.

In a first aspect, the present invention provides a tile holder comprising: at least one channel, said at least one channel constructed and arranged such that the tile holder is holding and displaying at least one rigid tile; and at least one lip for holding said at least one rigid tile within said channel, each of said at least one lip being adjacent said at least one channel; and wherein said tile holder is for labelling a storage device.

In a second aspect, the present invention provides a device for use with rigid tiles, the device comprising: a first end comprising a first channel; a second end comprising a second channel; wherein said first channel and said second channel are sized to accommodate one of: a rigid tile and a tile holder; and said first end is joined to said second end at an angle.

In a third aspect, the present invention provides for a tile holder comprising: a face plate comprising: a front side with at least one opening, said at least one opening being for displaying at least one rigid tile and said front side being for keeping said at least one rigid tile within said tile holder; and a frame around an outer perimeter of said front side, said frame being for supporting said at least one rigid tile; wherein said tile holder is for labelling a storage device.

In a fourth aspect, the present invention provides for a device for use with a rigid tile holder, wherein said device comprises a channel with a first end and a second end, wherein said first end is closed and said second end is open, wherein said second end is configured to fit over a holder channel of said rigid tile holder.

In a fifth aspect, the present invention provides for a tile holder comprising: a back side for coupling to a storage device; at least one channel coupled to said back side, each of said at least one channel comprising: a front side with at least one opening, said at least one opening being for displaying at least one rigid tile and said front side being for keeping said at least one rigid tile within said tile holder; and a frame around an outer perimeter of said front side, said frame being for supporting said at least one rigid tile.

BRIEF DESCRIPTION OF THE DRAWINGS

The present invention will now be described by reference to the following figures, in which identical reference numerals refer to identical elements and in which.

The figures are not to scale, and some features may be exaggerated or minimized to show details of particular elements while related elements may have been eliminated to prevent obscuring novel aspects. Therefore, specific structural and functional details disclosed herein are not to be interpreted as limiting but merely as a representative basis for teaching one skilled in the art to variously employ the present invention.

DETAILED DESCRIPTION OF THE INVENTION

The present invention provides a tile holder for holding rigid tiles. The tile holder can be attached to or integrated into a storage device, such as a shelf, door, jar, storage tote, backpack, cabinet, or drawer. The tile holder may be used in settings where labelling may be required. Such settings may include a pantry, a clothes closet, a locker room, a classroom, a bar, a garage, a bathroom, an office, a laboratory, a warehouse, or a kitchen. The tile holder may hold, for example, tiles with individual letters, numbers, and/or patterns on each tile.

The tile holder may be constructed from a rigid material, such as wood, a suitable metal, such as aluminum or stainless steel, or any suitable combination thereof. Similarly, the tile holder may be constructed out of a semi-flexible and/or resilient material, such as thick rubber, a flexible plastic, or any suitable combination thereof. The tile holder may be attached to a storage device using, for example, glue, nails, screws, snap-fit, tension fit, or any other suitable attachment means.

Figure 1:
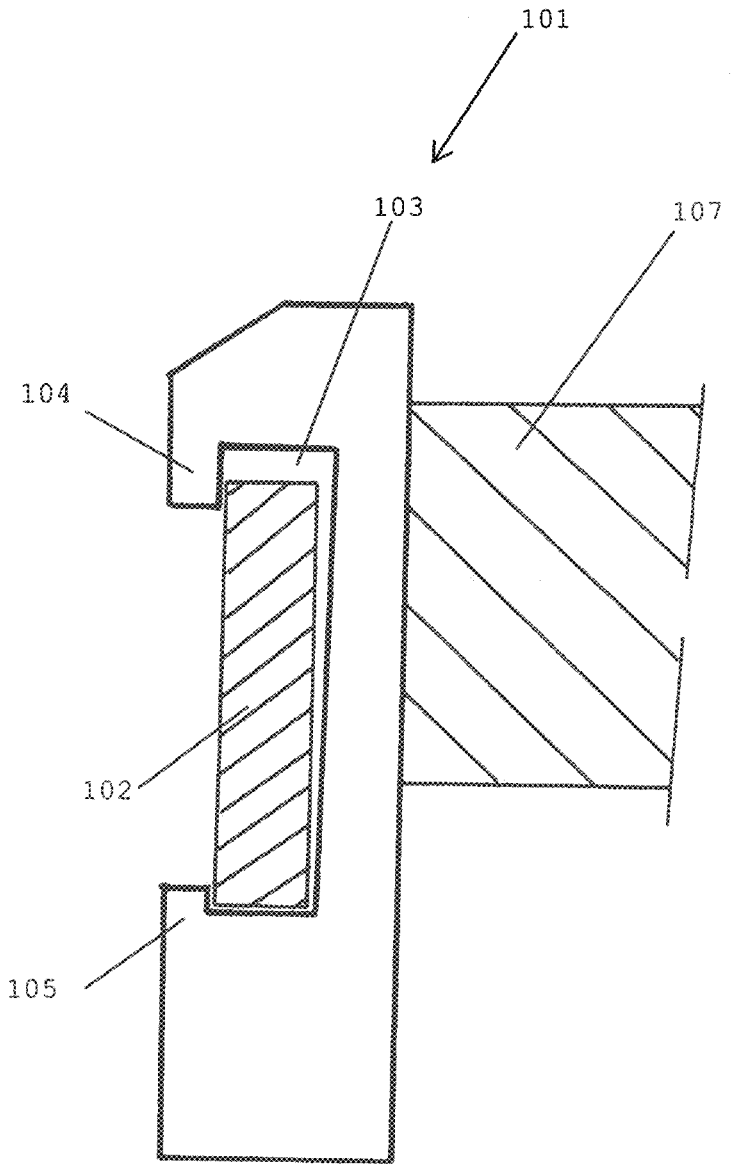
FIG. 1 is a cross sectional view of a tile holder according to a first embodiment of the present invention mounted to the front of a shelf.

FIG. 1 shows a cross sectional view of a tile holder 101 according to the first embodiment, holding a rigid tile 102. As can be seen, the tile holder 101 has a channel 103, which is shaped and sized to hold and display at least one rigid tile 102. The channel 103 is defined by the upper and lower sides with the tile being supported by the lower side. In addition to these, a back wall further supports the tile as the tile partially rests on the back wall.

The tile holder 101 has a first lip 104 and a second lip 105 opposite to the first lip 104. The first 104 and second lips 105 prevent the rigid tile 102 from falling or being knocked out of the channel 103.

The rigid tile 102 may be inserted through one end of the channel 103 or through the space between the first lip 104 and the second lip 105, if this space is wide or large enough.

In the first embodiment shown in FIG. 1, the tile holder 101 is mounted to the front of a shelf 107. The tile holder 101 may also function as a moulding trim for the shelf 107. Furthermore, the tile holder 101 may be mounted to the top or the underside of the shelf 107. In addition to the shelf 107, the tile holder 101 may be mounted to any suitable storage device or container.

In the first embodiment, the sides and wall forming the channel 103 may be partially or fully lined with a material that provides compression or cushioning to the tile. Such a material would assist in keeping the rigid tiles 102 in place. Such a material may line the top and/or bottom sides as well as the back wall. The material would, preferably, be compressible and/or resilient.

In the first embodiment, the channel 103 may be sized to prevent the insertion of the rigid tiles 102 from the front opening of the channel 103. Accordingly, the rigid tiles 102 would be inserted from an open end of the channel 103.

Alternatively, the channel 103 may be sized to allow the rigid tile 102 to be inserted vertically, with the ceiling having enough space to allow the bottom of the rigid tile 102 to fit over the first lip 104. In another embodiment, the channel 103 may be sized to allow the rigid tile 102 to be inserted sideways (widthwise) and then be rotated into a vertical position.

The rigid tile 102 is, preferably, large enough so that the information indicator on the front face (i.e, the letter, number or pattern being displayed) is clearly visible through the space between the first lip 104 and the second lip 105.

Figure 2:
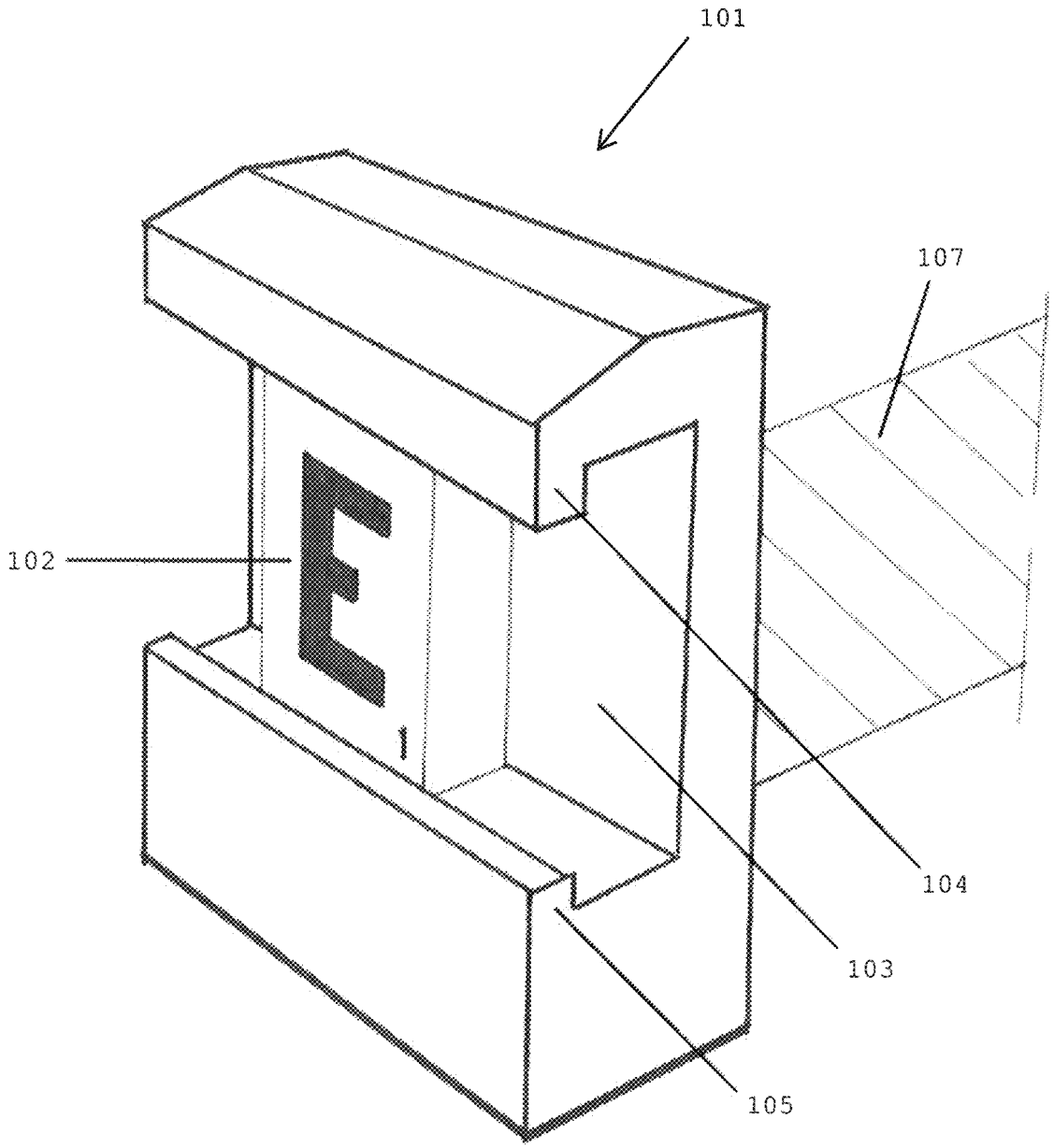
FIG. 2 is a perspective view of the tile holder according to the first embodiment mounted to the front of a shelf.

FIG. 2 shows a perspective view of the tile holder 101 illustrated in FIG. 1.

Figure 3:
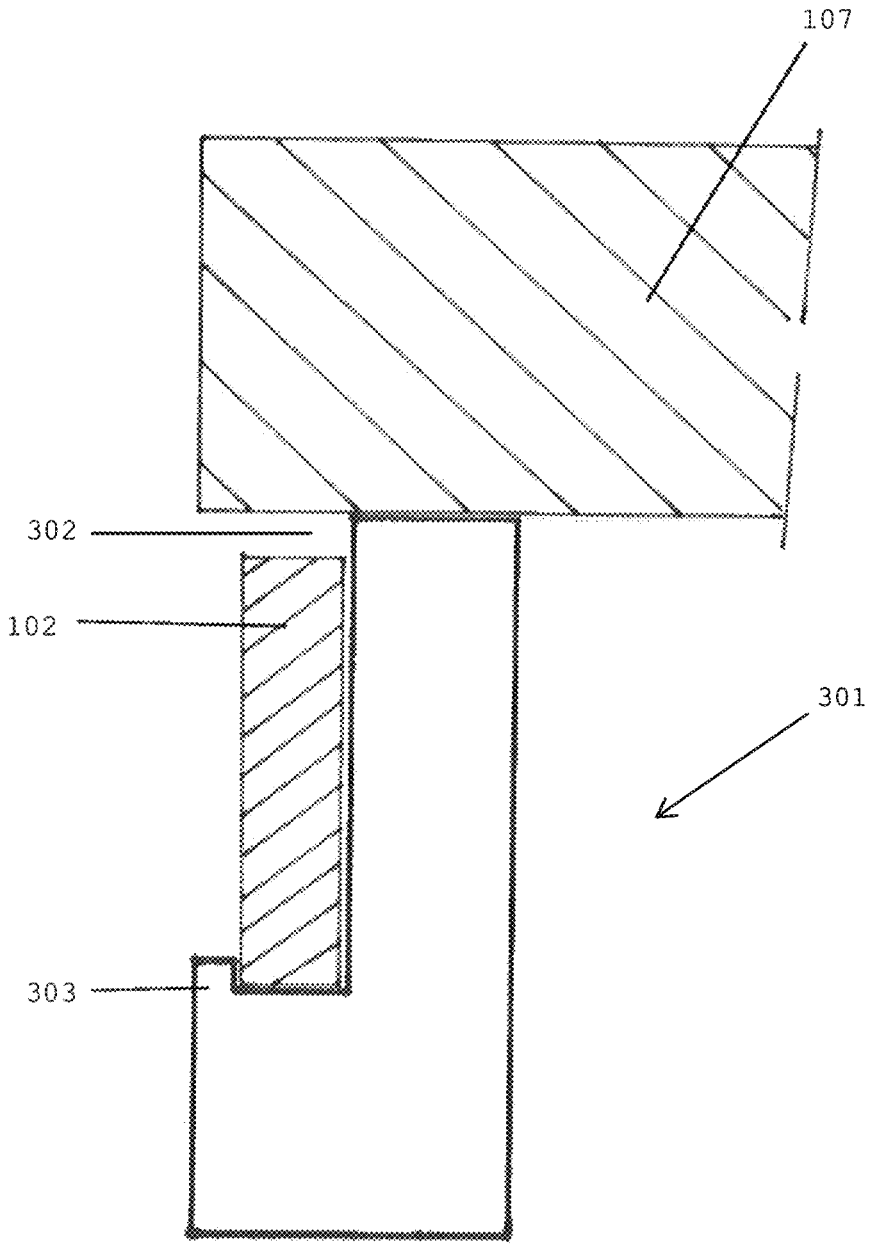
FIG. 3 is a cross sectional view of a tile holder according to a second embodiment of the present invention mounted to the underside of a shelf.

FIG. 3 shows a cross sectional view of a tile holder 301 according to a second embodiment of the present invention. The tile holder 301 comprises a channel 302 that is shaped and sized to simultaneously hold and display at least one rigid tile 102. The channel 302 is defined by a bottom side and a back wall. The bottom side supports the bottom of the rigid tile 102 while the back wall supports the back of the rigid tile. As can be seen, the tile holder 301 is suspended underneath the shelf 107 and the shelf 107 forms a top side for the channel.

The channel 302 may be formed by a lip 303 to hold the rigid tile 102 inside the channel 302.

The rigid tile 102 may be inserted through an end of the channel 302 or through the space between the shelf 107 and the lip 303, if this space is large enough.

Figure 4:
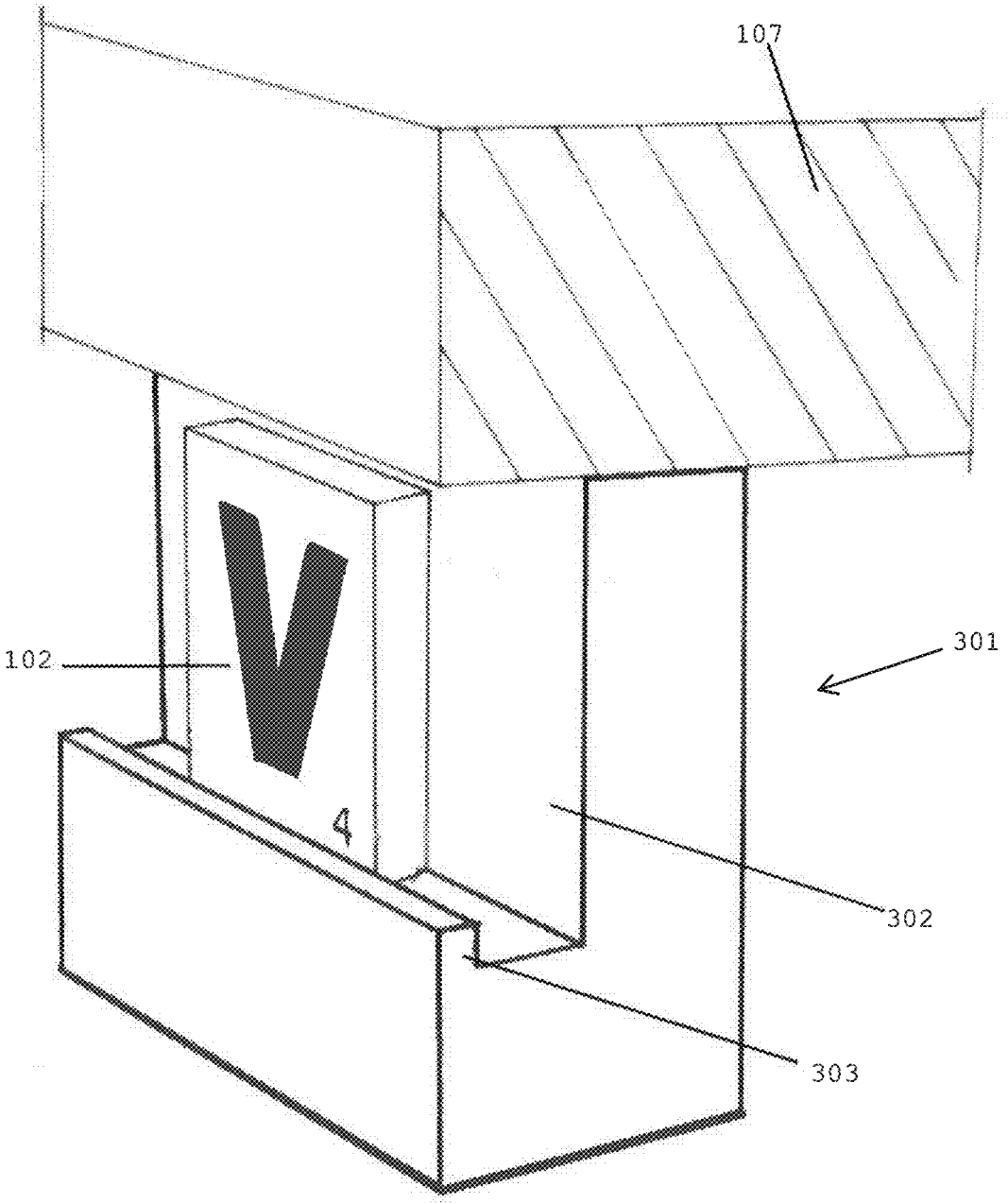
FIG. 4 is a perspective view of the tile holder according to the second embodiment mounted to the underside of a shelf.

FIG. 4 shows a perspective view of the tile holder 301 illustrated in FIG. 3. As can be seen, the rigid tile 102 need not be so large as to completely fill the channel. The rigid tile 102 is, preferably, large enough so that the information indicator on its front face (i.e., the letter, number or pattern being displayed) is clearly visible through the space between the lip 303 and the shelf 107.

Figure 5:
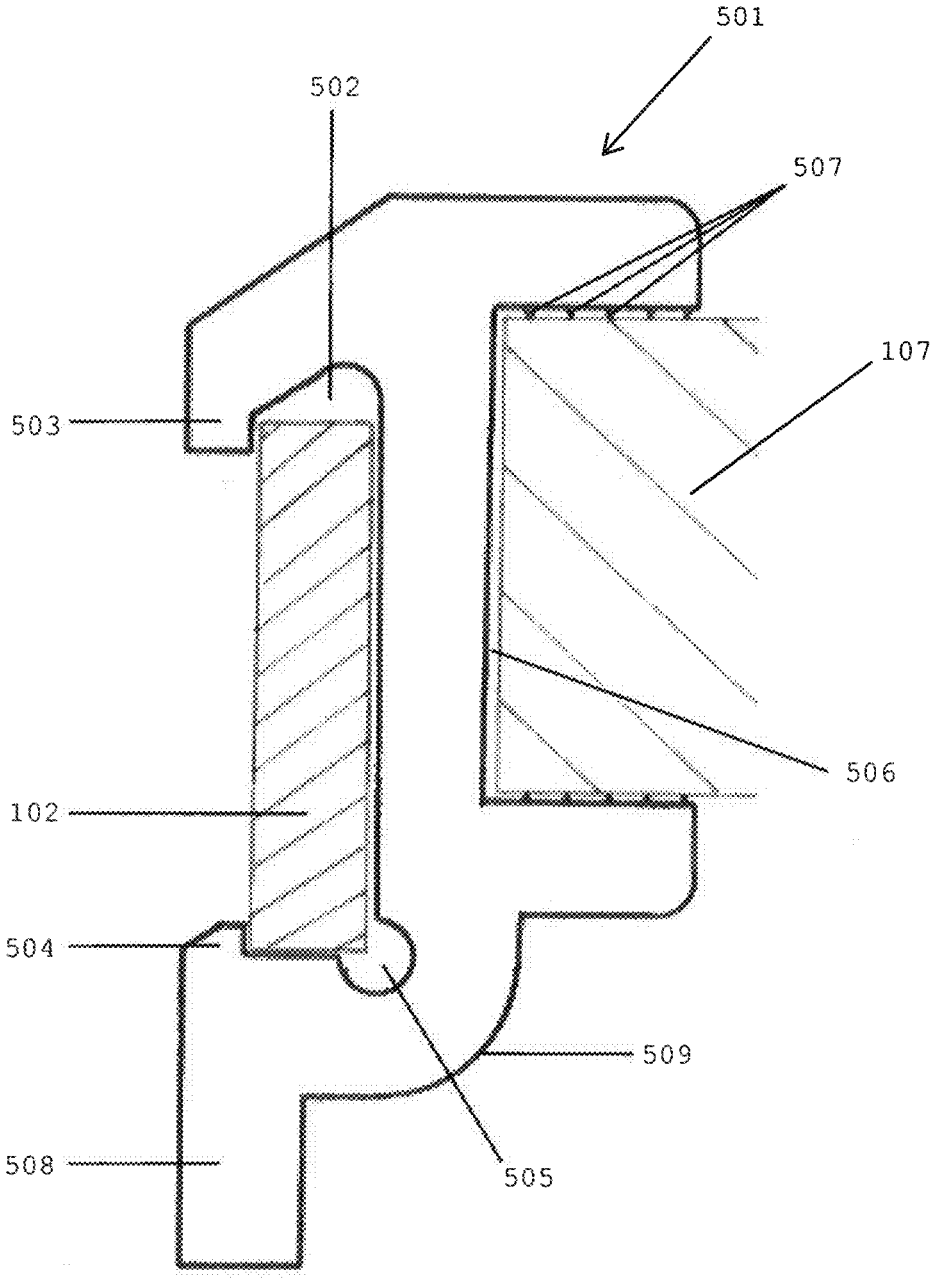
FIG. 5 is a cross sectional view of a tile holder according to a third embodiment of the present invention mounted to the front of a shelf.

FIG. 5 shows a cross sectional view of a tile holder 501 according to a third embodiment of the present invention. The tile holder 501 comprises a channel 502 that is shaped and sized to hold and display at least one rigid tile 102. The channel 502 is defined by upper and lower sides and a back wall. The rigid tile 102 is supported by the lower side and back wall.

Similarly to the first embodiment, the channel 502 comprises a first lip 503 and a second lip 504, opposite to the first lip 503. The channel 502 further comprises a void 505 such that part of the tile holder forming the void 505 and the outer edge 509 can act as a hinge. In one embodiment, the part of the tile holder forming the void 505 may be made of a flexible or resilient material, such as rubber or plastic. In another embodiment, the present invention contemplates a living hinge.

The tile holder 501 further comprises a second channel 506 that is opposite to the tile-holding channel 502. The second channel 506 is shaped or sized to receive an edge or lip on any storage device. In a preferred embodiment, the second channel 506 is shaped and sized to receive a front or a ledge of a shelf 107. The portion of the tile holder 501 forming the second channel 502 may be lined with barbs 507 that provide a better grip on the shelf 107.

The tile holder 501 has an extension 508 that is attached to, but extends away from, the second lip 504. The second lip 504 is adjacent to the void 505. As the tile portion forming the void 505 acts as a hinge, the space between the first lip 503 and the second lip 504 can be momentarily increased by exerting pressure or force on the lowermost portion of the extension 508 in a direction towards the shelf 107. This force or pressure compels the tile portion forming the void 505 to act as a hinge and momentarily increase the space between the first lip 503 and the second lip 504. Preferably, the void 505 is a circular or substantially circular profile to facilitate an easier operation of the hinge. The circular profile of the void 505 may be reflected by a circular outline of the outer edge 509 of the void 505.

Figure 6:
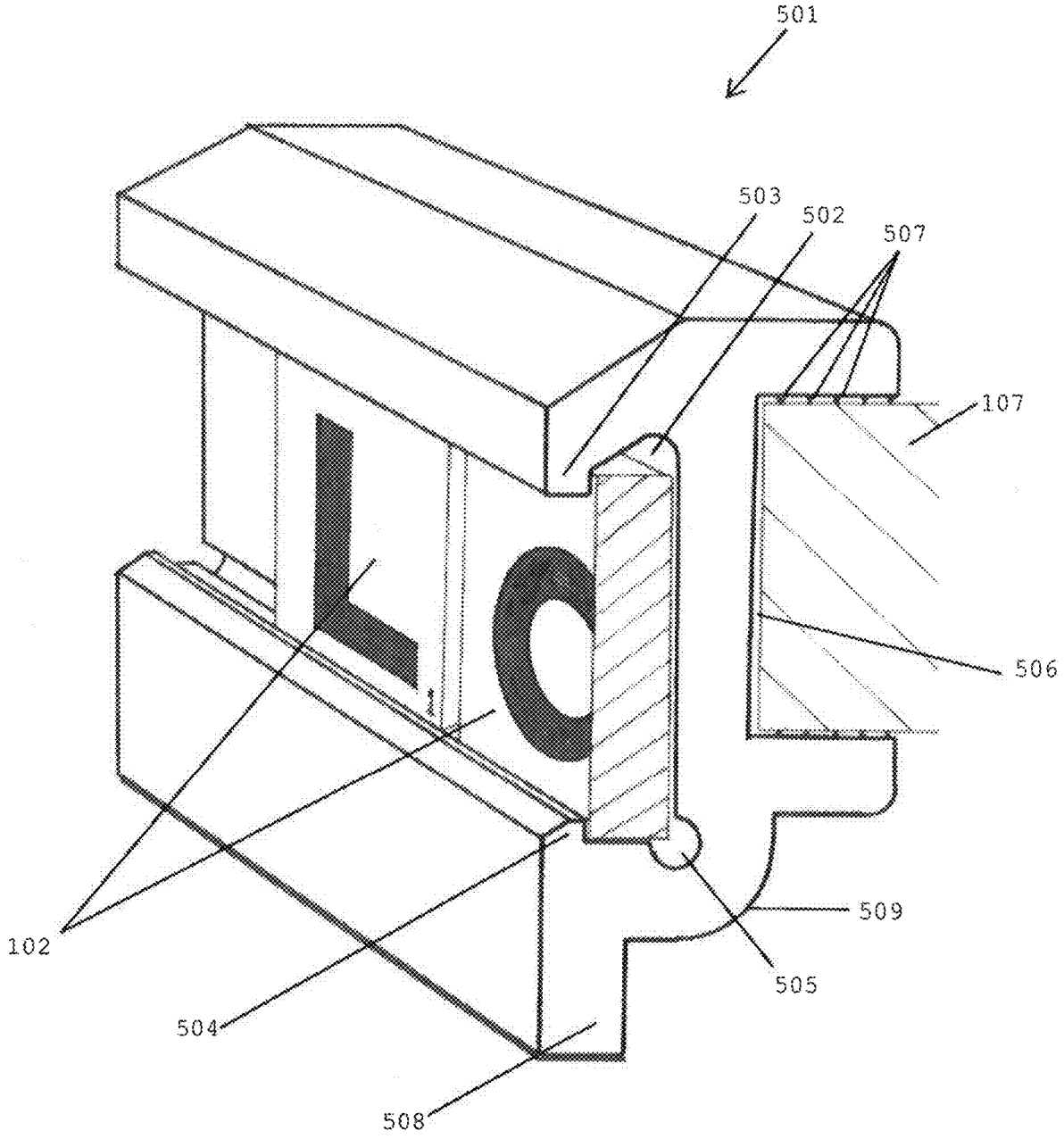
FIG. 6 is a perspective view of the tile holder according to the third embodiment mounted to the front of a shelf.

FIG. 6 is a perspective view of the tile holder 501 shown in FIG. 5. As can be seen, the void 505 extends along the channel 503 to facilitate the insertion of the rigid tiles 102 into the channel 503.

Figure 7:
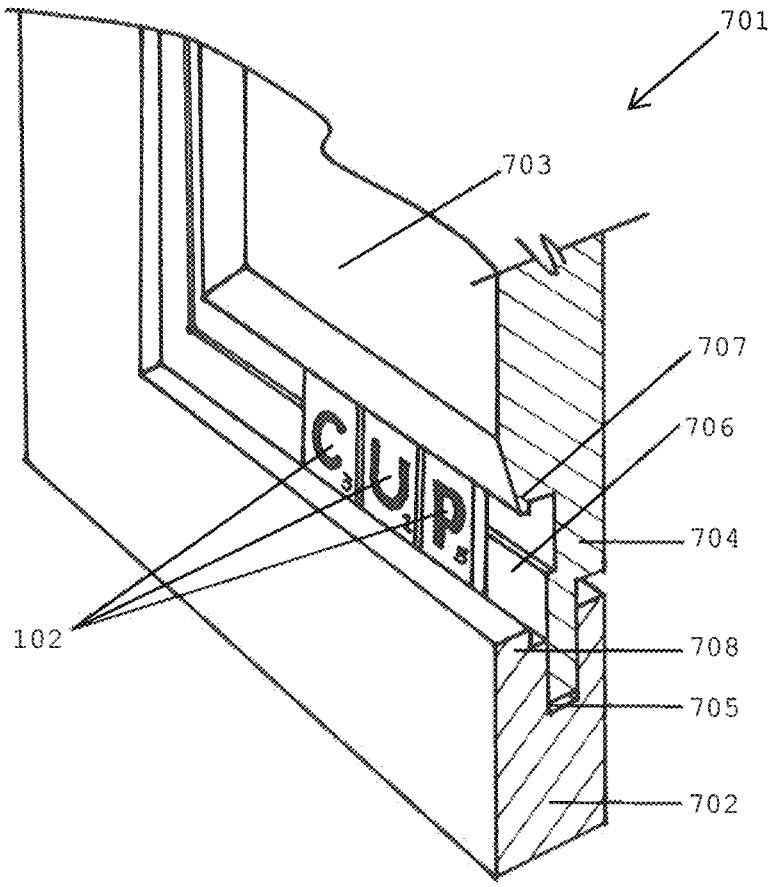
FIG. 7 is a perspective cross sectional view a cabinet door with an integrated tile holder according to a fourth embodiment of the present invention.

FIG. 7 illustrates a fourth embodiment of the present invention. FIG. 7 shows a perspective cross sectional view of an integrated tile holder 701 installed as the frame 702 of a door 703. The door 703 may be for any storage device that uses a door 703, such as a cabinet, shelf, cupboard or filing cabinet.

The integrated tile holder 701 has a frame 702 and a center panel 704 that is inserted into the body of the frame 702. The frame 702 comprises a groove 705 along the inner perimeter of the frame 702. The portion of the tile holder 701 forming the groove 705 is sized and shaped to hold an edge of the center panel 704.

In this embodiment, the integrated tile holder 701 is formed partially from the center panel 704 and partially from the frame 702. In other embodiments, the integrated tile holder 701 may be entirely formed or cut out of the center panel 703. Alternatively, the integrated tile holder 701 may be entirely formed or cut out of the frame 702 or an additional material.

The integrated tile holder 701 comprises a channel 706 that is shaped and sized to receive and display the rigid tiles 102. In FIG. 7, the channel 706 is defined by an upper side comprised of the center panel 704 and a lower side comprised of the frame 702, with the tile being supported by the lower side. A back wall further supports the tile as the tile partially rests on the back wall. However, a channel 706 may be formed on either side or the top of the door 703. For example, a channel 706 may be formed along the left side of the door 703 with the channel 706 being defined by a right side comprised of the center panel 704 and a left side comprised of the frame 702. Accordingly, the bottom rigid tile 102 would be supported by the bottom side and each subsequent rigid tile 102 would stack on top of the rigid tile 102 immediately underneath it. Similarly, a channel 706 may be formed along the top of the door 703 with the channel 706 being defined by an upper side comprised of the frame 702 and a lower side comprised of the center panel 704, with the tile being supported by the lower side.

The channel 706 may be defined further by a first lip 707 and a second lip 708 that are opposite to each other. The first lips 707 and the second lip 708 are for keeping the rigid tiles 102 within the channel 708.

Figure 8A:
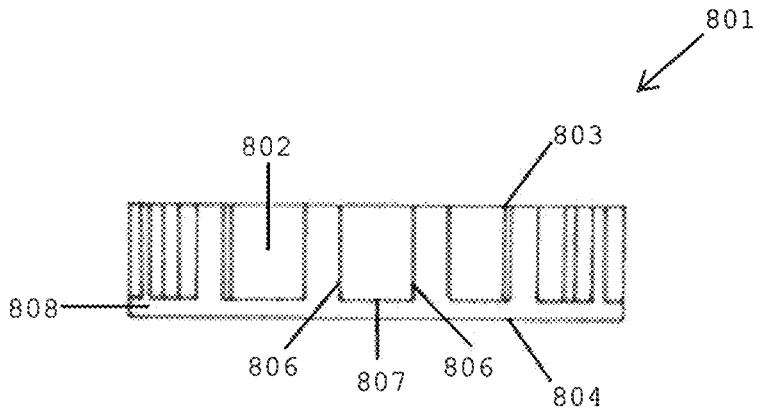
FIG. 8A is a side view of a circular tile holder according to a fifth embodiment of the present invention.

FIG. 8A shows a side view of a tile holder 801 according to a fifth embodiment of the present invention. FIG. 8A shows a tile holder 801 that uses multiple channels 802, with each channel 802 being shaped and sized to simultaneously receive and display at least one rigid tile 102 (see FIG. 9). In one embodiment, the portion of the tile holder 801 forming each channel 802 may be shaped and sized to hold multiple rigid tiles 102 that are stacked on top of one another.

The tile holder portion forming the channels 802 each have an open end 803 and a closed end 804. The closed end 804 keeps the rigid tile 102 within the channel 802. Each channel 802 may further comprise a first lip 805, a second lip 806, and a third lip 807. The first 805, the second 806, and the third lips 807 are for keeping the rigid tiles 102 within the channel 802. As can be seen, the various lips surround a space through which the letter, number or pattern on the rigid tile 102 can be viewed. The first 805, the second 806, and the third lips 807 are present at all sides of the channel 802 except for the same side where the open end 803 is present. Each channel 802, defined by the open 803 and the closed ends 804 and the first 805, the second 806, and the third lips 807, is cut into a band 808.

Figure 8B:
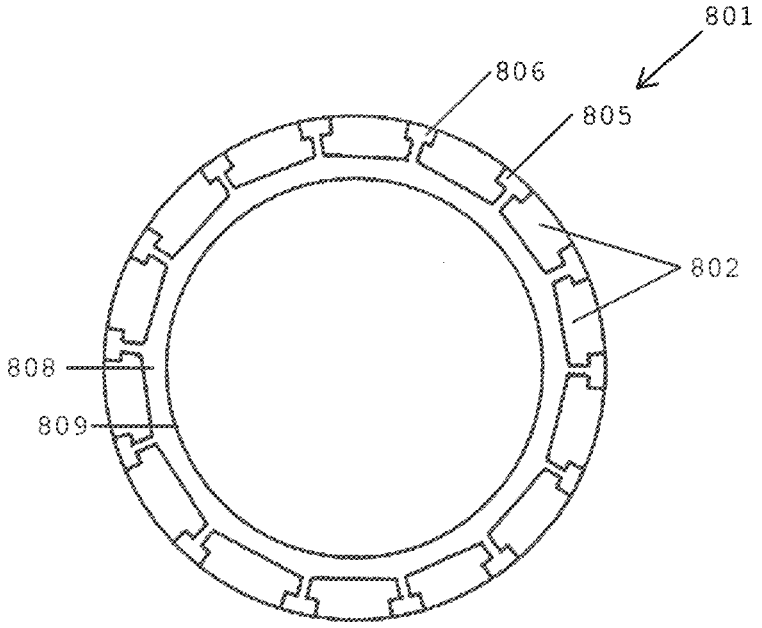
FIG. 8B is a top view of the circular tile holder according to the fifth embodiment.

FIG. 8B shows a top view of the fifth embodiment. As shown in FIG. 8B, the band 808 may be placed to encircle an opening for a storage device, such as a mason jar. The band 808 may completely or partially encircle the storage device opening. The band 808 may further comprise a lip 809. The lip 809 allows the tile holder 801 to rest on a ledge or rim of a storage device and retain the lid of the storage device.

A skilled artisan would understand that, while the tile holder 801 shown in FIG. 8B is circular, the tile holder 801 may be formed to the shape of any storage device opening. Many different shapes are contemplated by the present invention.

Figure 9:
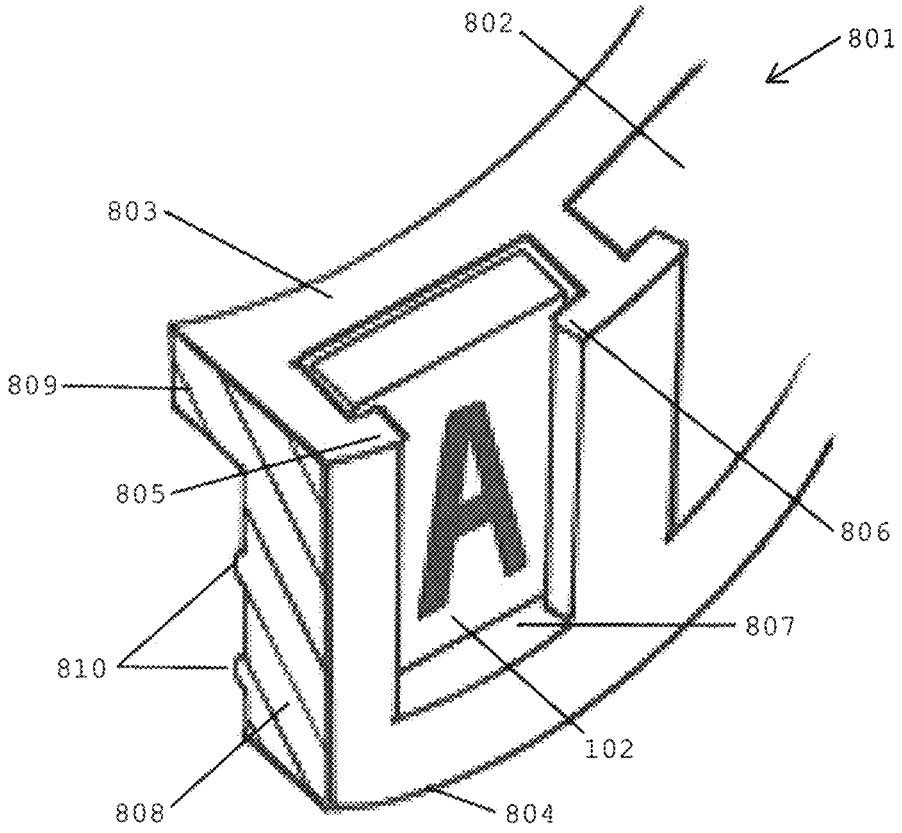
FIG. 9 is a perspective cross sectional view of the circular tile holder according to the fifth embodiment.

FIG. 9 shows a perspective cross sectional view of the fifth embodiment. The tile holder 801 may be further comprised of integrated female internal threads 810 on the band 808. The female internal threads 810 may be used to thread the tile holder 801 onto the male external threads of a storage device, such as a mason or ball jar. As such, in addition to lip 809, the female internal threads 810 help to secure the lid to the storage device.

In an alternate embodiment, the band 808 would be provided without the female internal threads 810. In this embodiment, the band 808 would be made of a flexible material such as rubber or plastic that could be stretched over an existing jar band.

Figure 10:
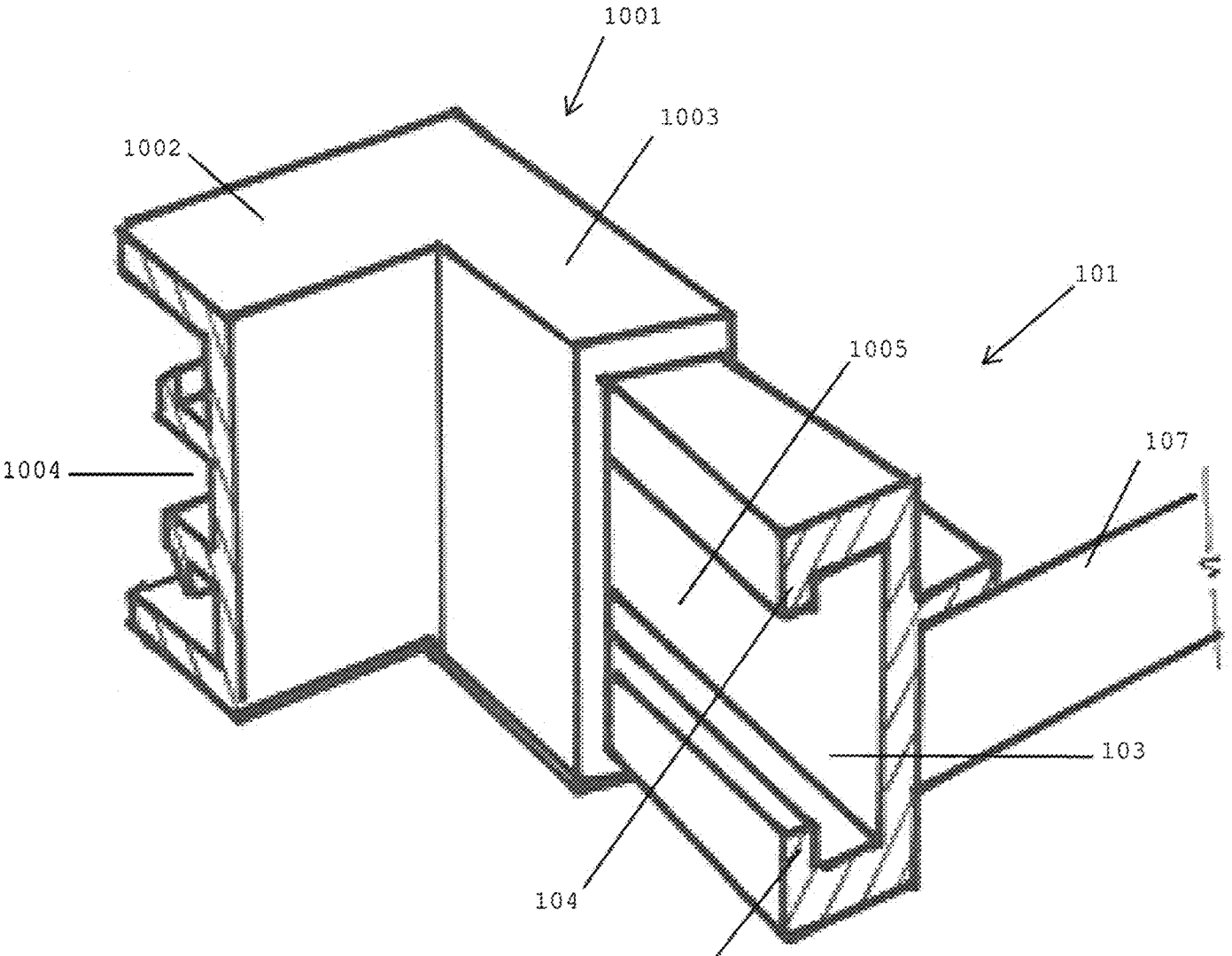
FIG. 10 is a perspective cross sectional view of a device for use with rigid tiles according to a sixth embodiment of the present invention.

FIG. 10 shows a perspective cross sectional view of a device 1001 according to a sixth embodiment of the present invention. FIG. 10 shows the device 1001 fitted over the tile holder 101. However, the device 1001 may be modified to fit over the tile holder 301 (see FIG. 3) or the tile holder 501 (see FIG. 5).

The device 1001 may be used to connect two tile holders 101 together at an angle. In the figure, it can be seen that the tile holder 101 is mounted to a shelf 107. The device 1001 comprises a first end 1002 and a second end 1003. The first end 1002 has a first channel 1004 and the second end 1003 has a second channel 1005. The first 1004 and the second channels 1005 may be formed around the tile holder 101.

The first 1004 and second channels 1005 are formed to fit around and securely form the channel 103 of the tile holder 101. More specifically, the first 1004 and second channels 1005 may be formed around the first 104 and second lips 105 of the tile holder 101. Accordingly, a device 1001 that is formed to fit around tile holder 501 would have first 1004 and second channels 1005 that are formed to fit around the extension 508.

In the embodiment shown, the first 1002 and the second ends 1003 are joined at a 90 degree angle. In alternative embodiments, the first 1002 and the second ends 1003 may be joined at any angle. In one example, the first 1002 and the second ends 1003 are joined at 180 degrees, thereby resulting in a coupler that joins two separate tile holders 101.

Figure 11:
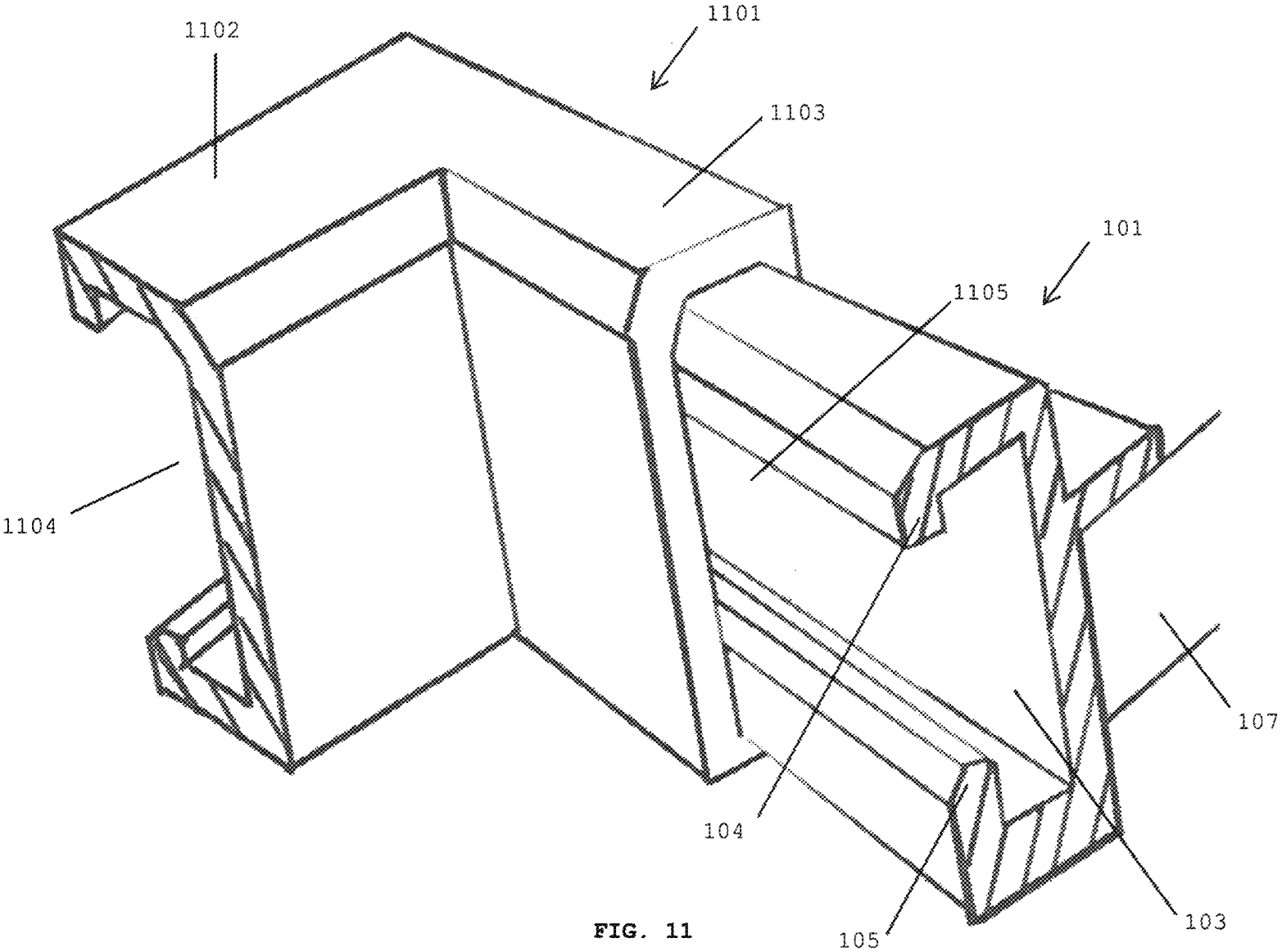
FIG. 11 is a perspective cross sectional view of a device for use with rigid tiles according to a seventh embodiment of the present invention.

FIG. 11 shows a device 1101 according to a seventh embodiment of the present invention. FIG. 11 shows a device 1101 that can fit over the tile holder 101. The device 1101 has a first end 1102 and a second end 1103. The first end 1102 has a first channel 1104 and the second end 1103 has a second channel 1105. The first channel 1104 is a larger version of the channel 103 on the tile holder 101. The portion of the device 1101 forming the first channel 1104 is shaped and sized for receiving the tile holder 101 while also being able to hold and display rigid tiles 102 (see FIG. 1). In an alternative embodiment, either or both of the portions forming first 1104 and the second channels 1105 may be shaped to fit around another tile holder 101. Thus, the device 1101 may act as a coupler between two tile holders 101. Alternatively, the device 1101 may act as a tile holder on either the first 1102 or the second end 1103, while being coupled to a tile holder 101 at the other end. Similarly to the device 1001, the device 1101 shown in FIG. 11 may be used with other tile holders according to other embodiments, such as the tile holder 301 or the tile holder 501.

Figure 12A:
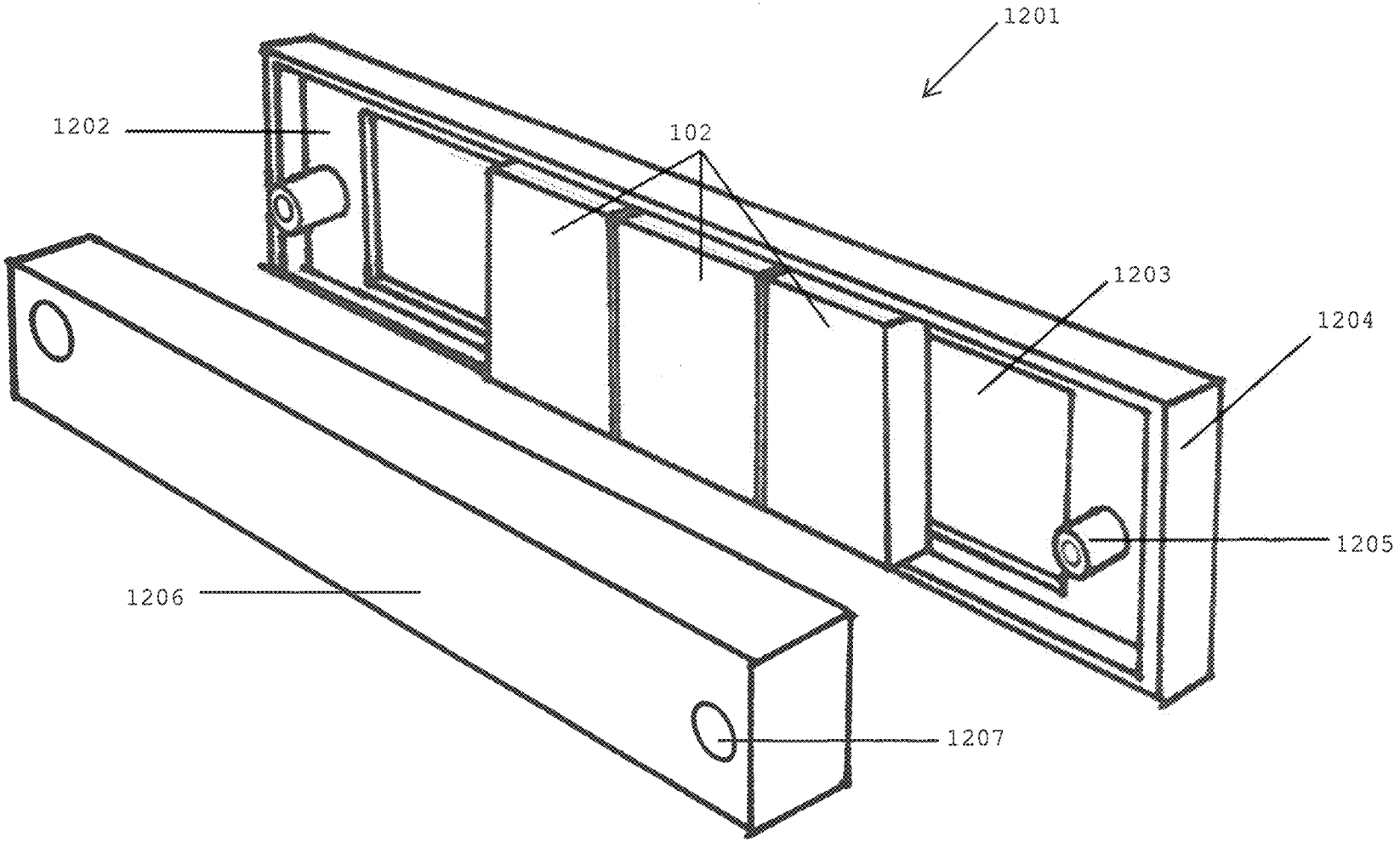
FIG. 12A is a perspective view of a tile holder and a spacing block according to an eighth embodiment of the present invention.
Figure 12B:
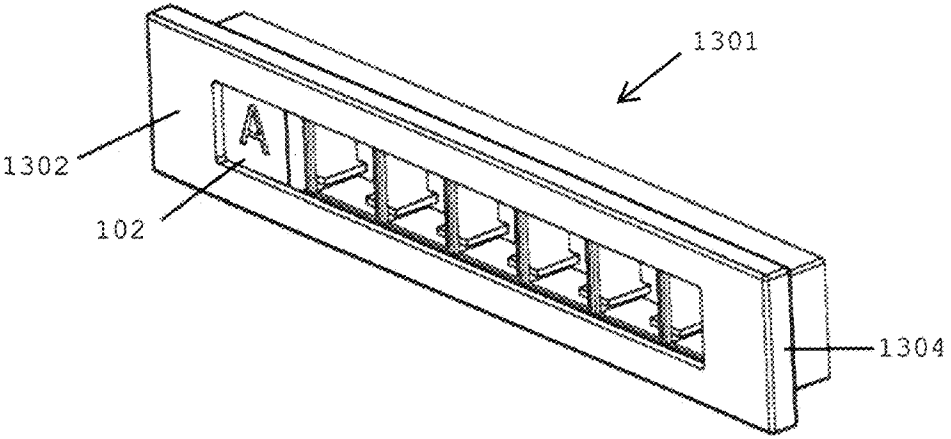
FIG. 12B is a perspective view of a tile holder and a spacing block according to another embodiment of the present invention, in a first position.

FIG. 12A shows a tile holder 1201 according to an eighth embodiment of the present invention. This embodiment incorporates the tile holder 1201 in a handle for a storage device (e.g. a drawer, filing cabinet, desk, etc.). In this embodiment, the tile holder 1201 comprises a face plate 1202 with an opening 1203. The face plate 1202 and the opening 1203 are preferably shaped and sized to simultaneously expose one face of each rigid tile 102 and to keep the rigid tiles 102 within the tile holder 1201. Specifically, the face plate 1202 forms a channel that operates to prevent the rigid tiles 102 from falling through the opening 1203. The opening 1203 may be covered with a transparent or a translucent material. Alternatively, the opening 1203 may be uncovered.

The tile holder 1201 may use a frame 1204 around the outer perimeter of the face plate 1202. The frame 1204 may be used to support the rigid tiles 102 and to ensure that the rigid tiles 102 stay within the tile holder 1201.

As noted above, the tile holder 1201 may be mounted to the face of a storage device, such as a drawer, filing cabinet or desk. In one embodiment, the frame 1204 may be thinner than the rigid tiles 102, such that when the tile holder 1201 is mounted to a storage device, the rigid tiles 102 are securely held between the storage device and the face plate 1202.

The tile holder 1201 may further comprise one or more screw bosses 1205 for mounting the tile holder 1201 to a storage device using a suitable mounting means, such as screws. In the embodiment shown, the tile holder 1201 may be mounted to a storage device using a spacer block 1206. The spacer block 1206 may use one or more screw holes 1207. As can be imagined, each screw hole 1207 is aligned with a corresponding screw boss 1205.

FIGS. 12B to 12G show a tile holder 1301 according to another embodiment of the present invention. In this embodiment, the tile holder 1301 comprises a face plate 1302 with an opening 1303, a frame 1304, and a reversible spacer block 1306.

The front side of the face plate 1302 and the opening 1303 are preferably shaped and sized to simultaneously expose one face of each rigid tile 102 and to keep the rigid tiles 102 within the tile holder 1301. Specifically, the face plate 1302 forms one side of a channel that operates to prevent the rigid tiles 102 from falling through the opening 1303. The opening 1303 may be covered with a transparent or a translucent material. Alternatively, the opening 1303 may be uncovered.

The tile holder 1301 has a frame 1304 that is around the outer perimeter of the front side of the face plate 1302, such that the face plate 1302 and the frame 1304 form a channel. The frame 1304 may be used to further support the rigid tiles 102 and to ensure that the rigid tiles 102 stay within the tile holder 1301.

The reversible spacer block 1306 forms a back side of the channel, to securely hold the rigid tiles 102 in place. The reversible spacer block 1306 has a first face 1308 and a second face 1310, such that the face plate 1302 and spacer block 1306 can be coupled in a first position (as shown in FIGS. 12B to 12E) or a second position (as shown in FIGS. 12F and 12G. The first position allows the rigid tiles 102 to be held between the reversible spacer block 1306 and the face plate 1302 in a manner where they are visible and can be used as a label. The second position allows the tile holder to be used without any rigid tiles 102.

Figure 12C:
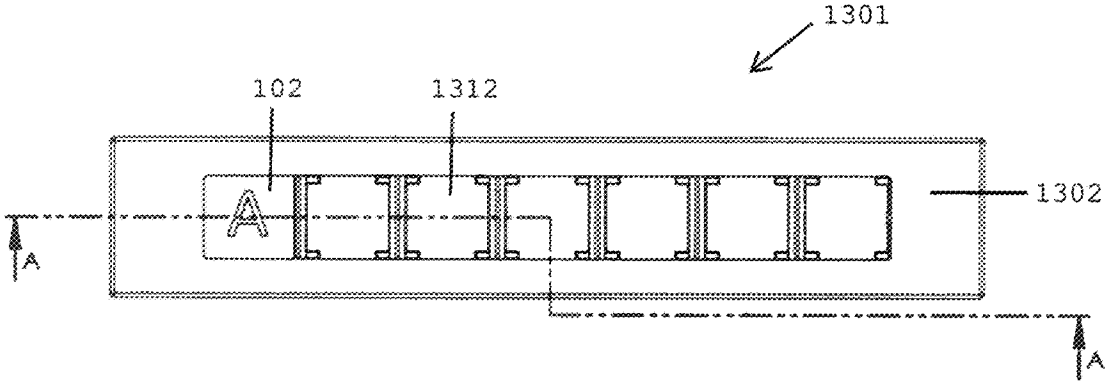
FIG. 12C is a front view of the tile holder shown in FIG. 12B in a first position.
Figure 12E:
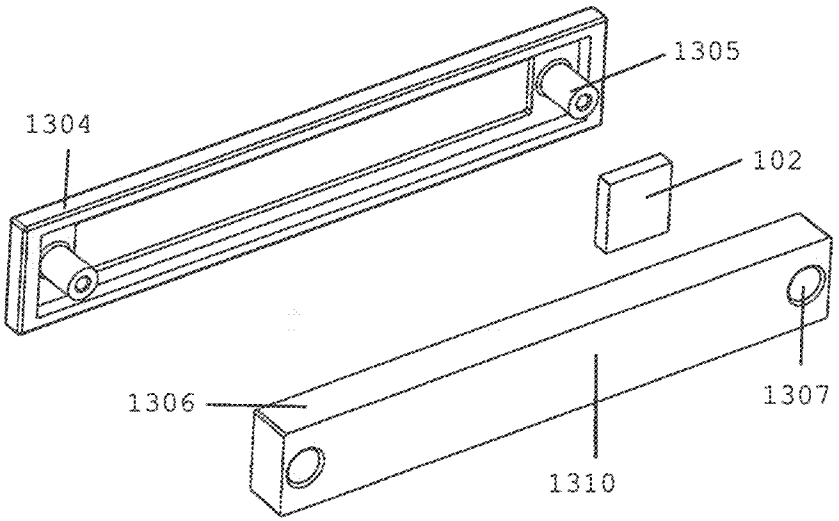
FIG. 12E is an exploded, rear perspective view of the tile holder and spacing block shown in FIG. 12B in a first position.
Figure 12D:
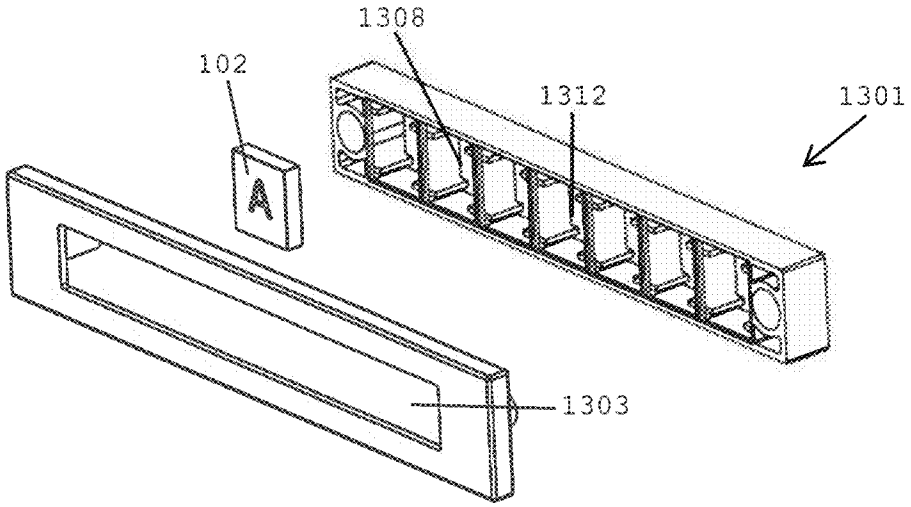
FIG. 12D is an exploded, front perspective view of the tile holder and spacing block shown in FIG. 12B in a first position.
Figure 12G:
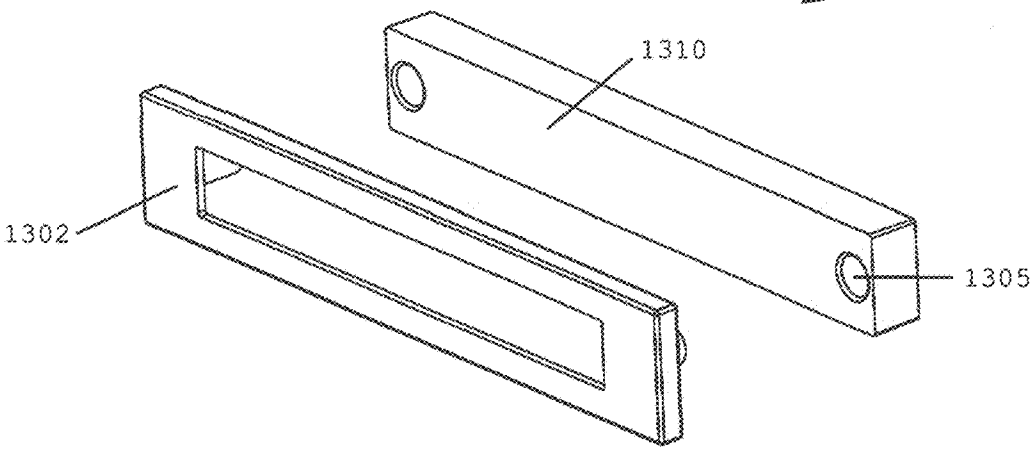
FIG. 12G is an exploded, front perspective view of the tile holder and spacing block shown in FIG. 12B in a second position.
Figure 12F:
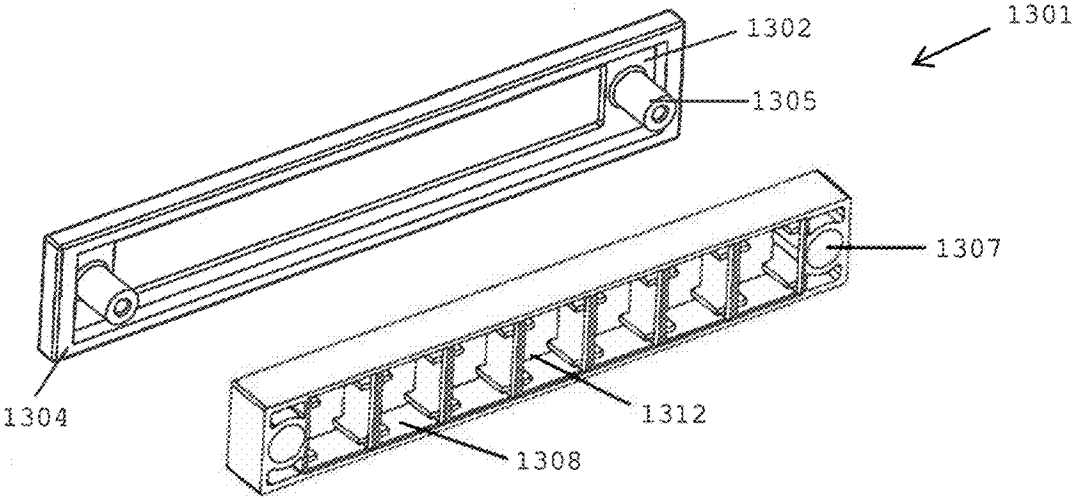
FIG. 12F is an exploded, rear perspective view of the tile holder and spacing block shown in FIG. 12B in a second position.

As shown in FIGS. 12C, 12D, and 12F, the first face 1308 of the reversible spacer block 1306 has individual channels 1312 for receiving at least a portion of a rigid tile 102 and retaining the rigid tile 102 in place. However, the first face 1308 of the spacer block 1306 may have a single channel that receives multiple rigid tiles 102 or multiple channels that receive one or more rigid tiles 102. The channels 1312 may also serve to space the rigid tiles 102 at a suitable distance from each other.

As shown in FIGS. 12E to 12G, the tile holder 1301 may further comprise one or more screw bosses 1305 for mounting the tile holder 1301 to a storage device using a suitable mounting means, such as screws. The spacer block 1306 may use one or more screw holes 1307. As can be imagined, each screw hole 1307 is aligned with a corresponding screw boss 1305.

Figure 12H:
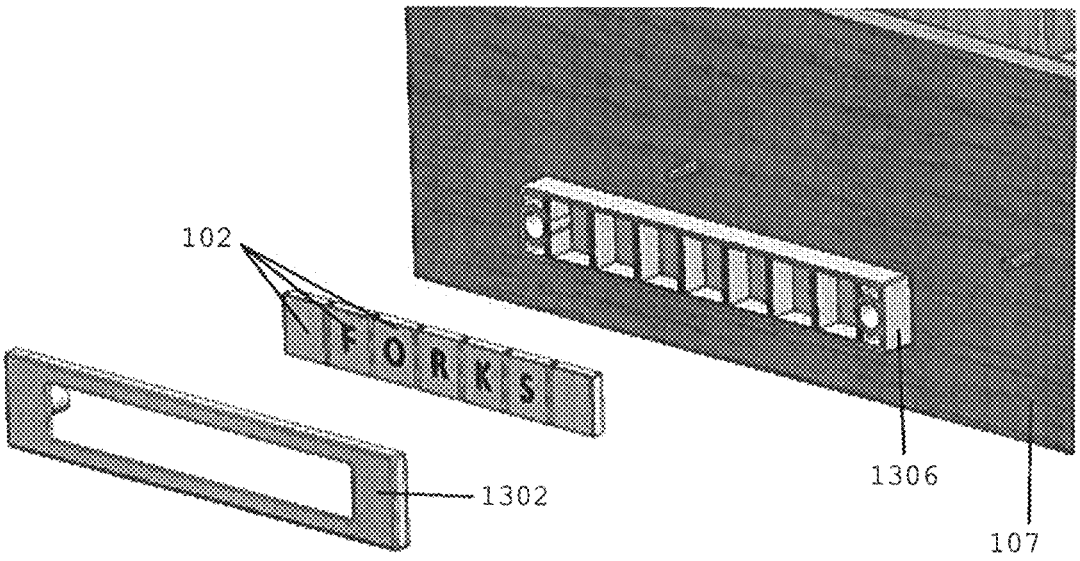
FIG. 12H is an exploded, front perspective view of the tile holder and spacing block shown in FIG. 12B in a first position.
Figure 12I:
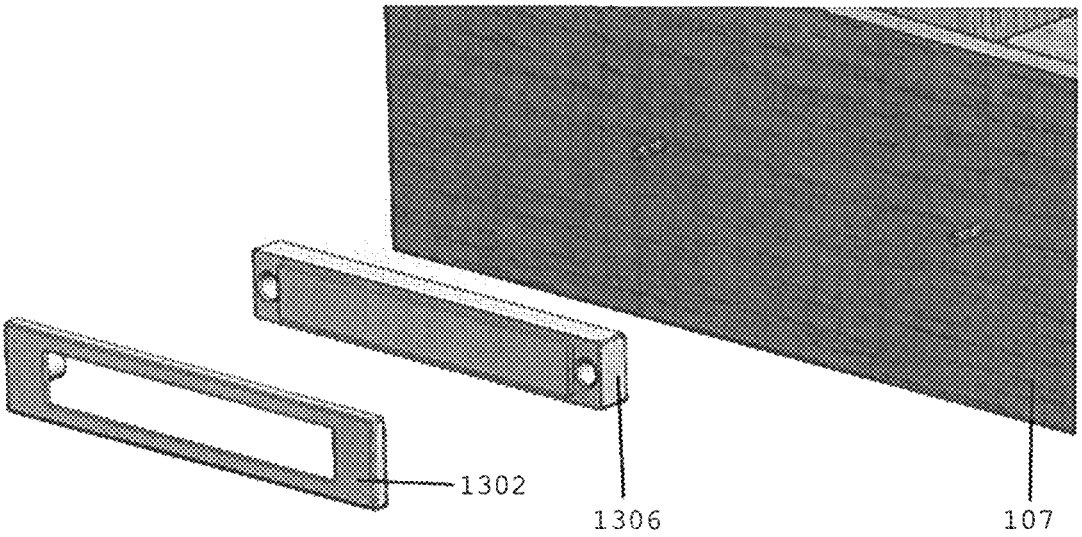
FIG. 12I is an exploded, front perspective view of the tile holder and spacing block shown in FIG. 12B in a second position.

FIGS. 12H and 12I show the tile holder 1301 in use on a storage device 107. Specifically, FIGS. 12H and 12I show how the tile holder 1301 can be used with a drawer on a storage device 107. As can be seen, the spacer block 1306 is reversible, such that the spacer block 1306 can be used with rigid tiles 102 (FIG. 12H) or without rigid tiles 102 (FIG. 12I).

Figure 13A:
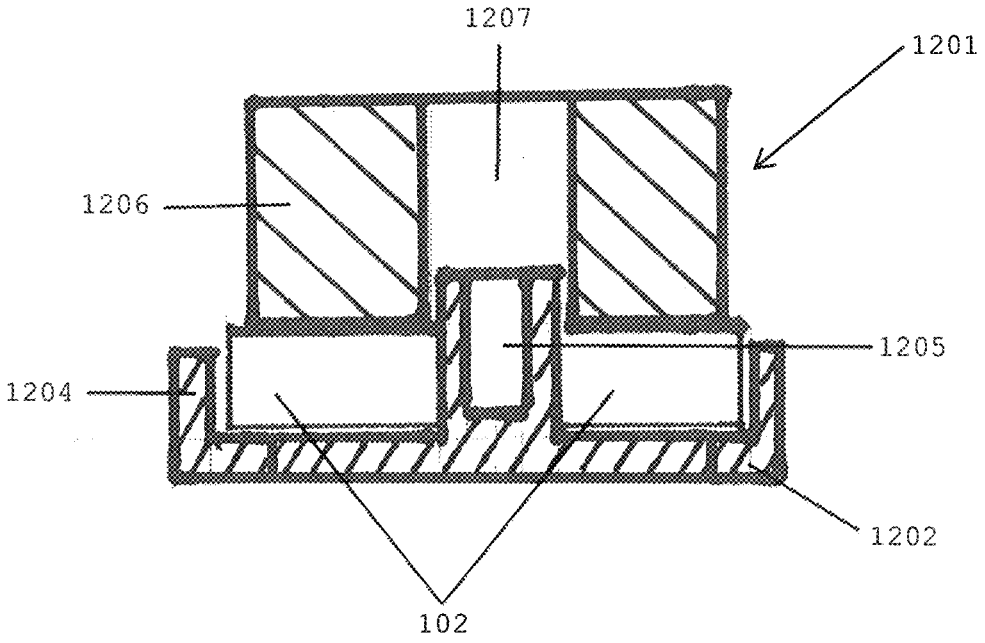
FIG. 13A is a cross sectional view of the tile holder and the spacing block according to the eighth embodiment shown in FIG. 12A.

FIG. 13A shows a cross sectional view of the tile holder 1201 illustrated in FIG. 12A.

Figure 13B:
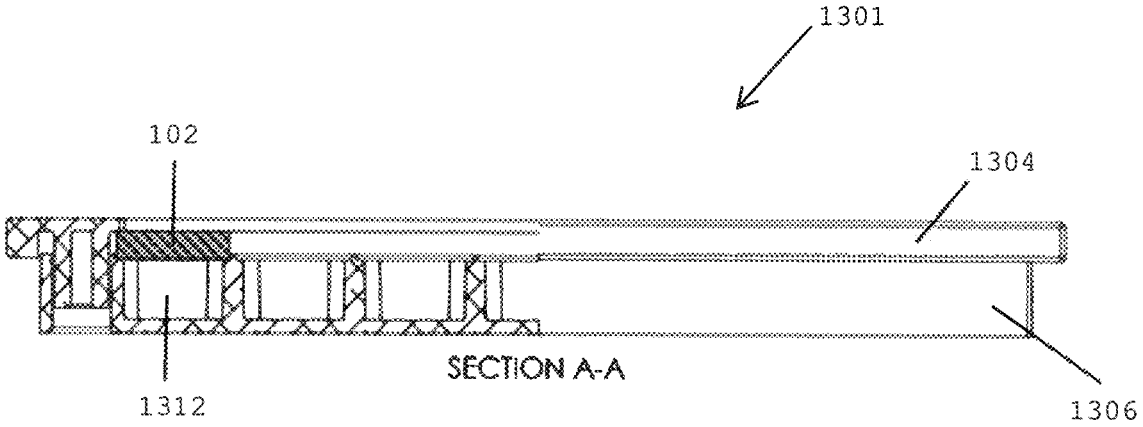
FIG. 13B is a cross sectional view of the tile holder and the spacing block along line A-A shown in FIG. 12C in a first position.

FIG. 13B shows a cross-sectional view of the tile holder 1301 taken at lines A-A of FIG. 12C. As shown in FIG. 13B, the rigid tile 102 may rest predominantly on the frame 1304, with a portion of the tile being supported by the channels 1312. Alternatively, the channels 1312 may be sized and shaped to fit the entire rigid tile 102 or the frame 1304 may be sized and shaped to fit the entire rigid tile 102.

Figure 14:
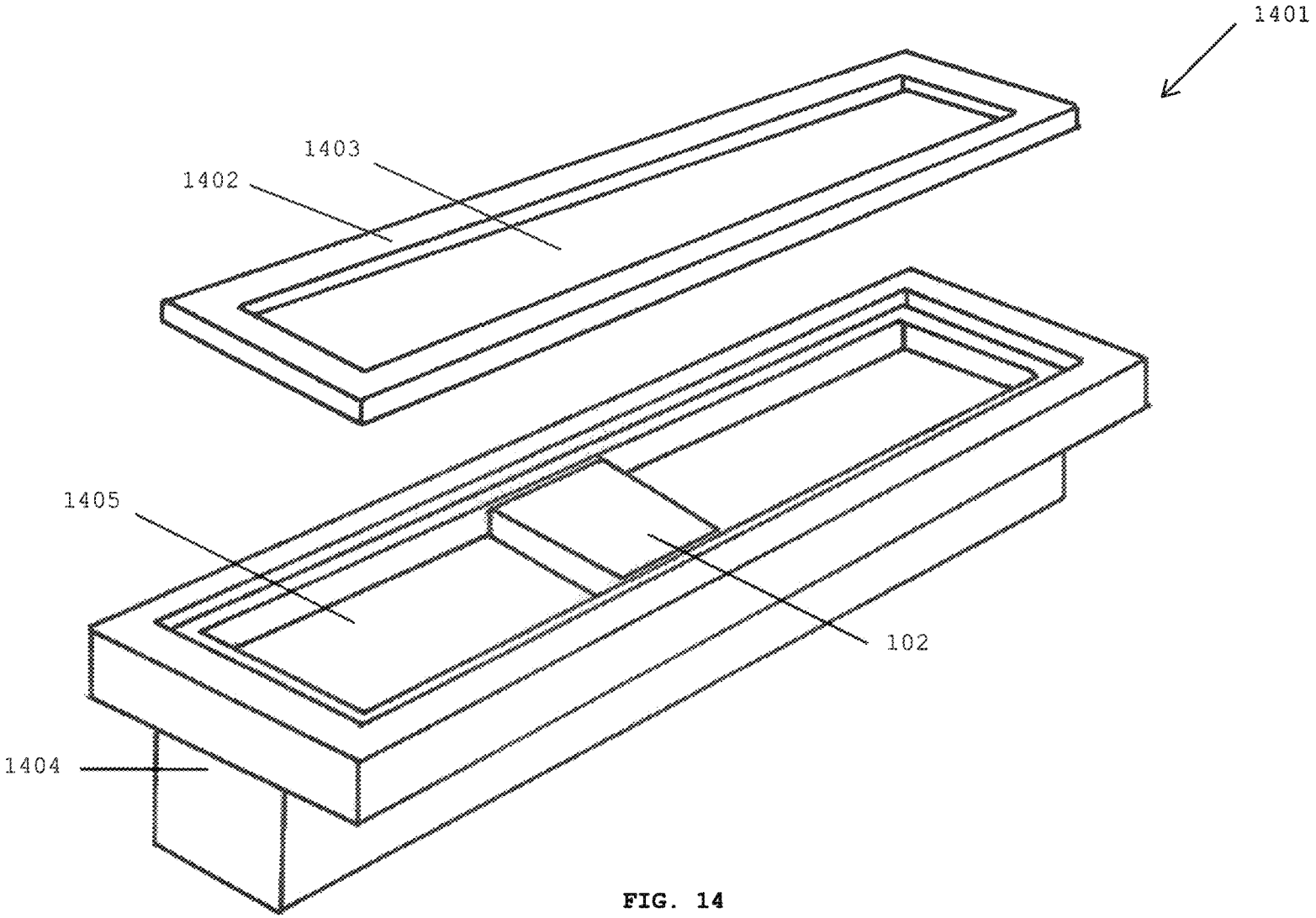
FIG. 14 is a perspective view of an integrated tile holder according to a ninth embodiment of the present invention.

FIG. 14 shows a perspective view of a tile holder 1401 according to a ninth embodiment of the present invention. The tile holder 1401 comprises a face plate 1402 with an opening 1403 and a spacer block 1404 with a channel 1405. When the face plate 1402 is coupled to the spacer block 1404, the channel 1405 acts as a frame to support the rigid tiles 102. The tile holder 1401 is similar to the tile holder 1201 shown in FIGS. 12A to 12G. The principal difference being that the tile holder 1401 of FIG. 14 has the channel 1405 within the spacer block 1404 for holding the rigid tiles 102.

The face plate 1402 and the channel 1405 are preferably shaped and sized to keep the rigid tiles 102 within the tile holder 1401. Specifically, the face plate 1402 and the channel 1405 operate together to prevent the rigid tiles 102 from falling through the opening 1403. The opening 1403 may be covered with a transparent or a translucent material to expose one face of each rigid tile 102. Alternatively, the opening 1403 may be uncovered.

The spacer block 1404 may be securely glued or fastened to the base of a handle of a storage device with suitable attachment means. Alternatively, the spacer block 1404 may be removably attached to the base of a handle, a door, countertop, or shelf of a storage device.

Figure 15:
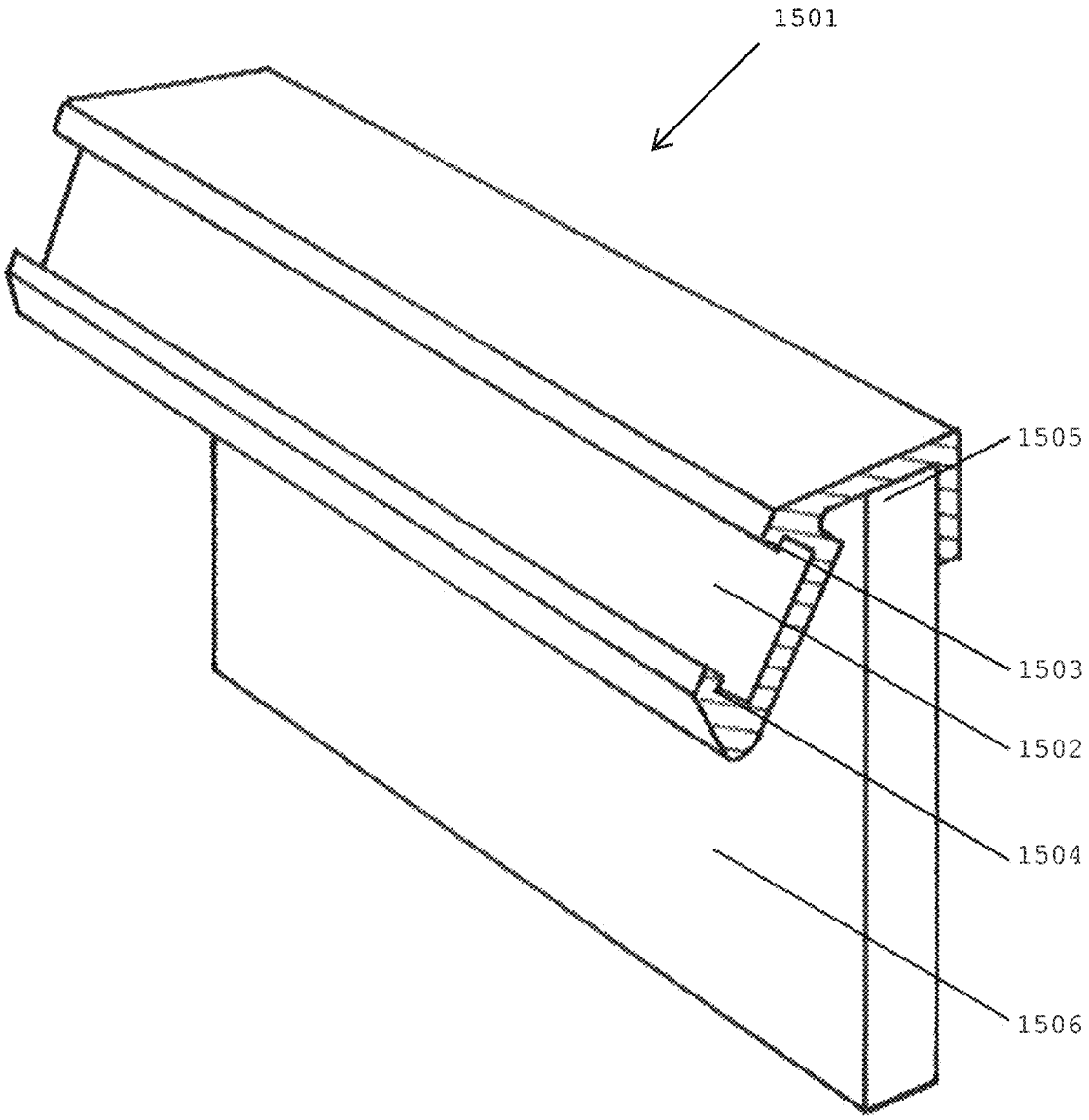
FIG. 15 is a perspective cross sectional view of a tile holder according to a tenth embodiment of the present invention mounted to the top of a drawer or cabinet door.

FIG. 15 shows a perspective cross sectional view of a tile holder 1501 according to a tenth embodiment of the present invention. Similar to tile holder 101, the tile holder 1501 comprises a channel 1502 with a first lip 1503 and a second lip 1504. The tile holder 1501 further comprises a second channel 1505 that is shaped and sized to fit over a door or drawer face 1506. For example, the tile holder 1501 may fit over the top, bottom or hinge-free side of a cabinet or cupboard door. Alternatively, the tile holder 1501 may fit over the top or bottom front face of a drawer.

The channel 1502 may integrate a flexible portion, such as a void 505 and an extension 508 (see FIG. 5), to allow for the insertion of the rigid tiles 102 from the front of the channel 1502. Furthermore, the portion of the tile holder forming the channel 1502 may be comprised of a flexible material, such as rubber or plastic, to prevent vibration while the drawer or door is opened or closed.

Figure 16:
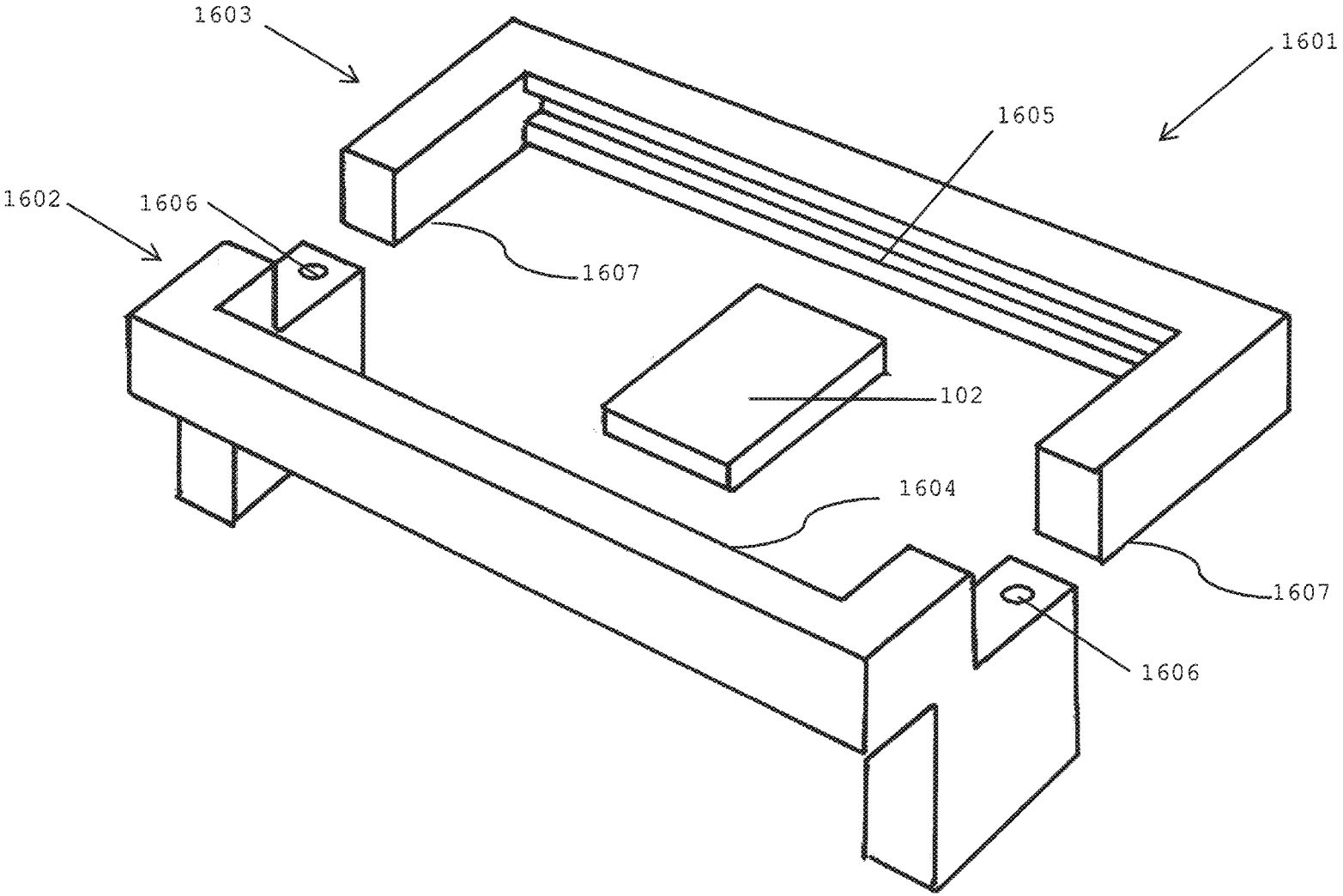
FIG. 16 is a perspective cross sectional view of a tile holder according to an eleventh embodiment of the present invention.

FIG. 16 shows a perspective view of a tile holder 1601 according to an eleventh embodiment of the present invention. The tile holder 1601 is formed as a handle for a storage device, such as a drawer, cupboard or filing cabinet. The tile holder 1601 is comprised of a handle 1602 and a tile support piece 1603. Collectively, the handle 1602 and the tile support piece 1603 form a channel that holds the rigid tiles 102. The rigid tiles 102 are supported and held securely in place by a first groove 1604 (not visible in FIG. 16) on the handle 1602 and a second groove 1605 on the tile support piece 1603.

The tile holder 1601 may have at least one hole 1606 on the handle 1602 to attach the tile support piece 1603 to the handle 1602 with a suitable attachment means. The suitable attachment means is inserted through the storage device, through the holes 1606, and lastly are threaded through a corresponding second hole 1607 (not visible in FIG. 16) on the tile support piece 1603.

Figure 17:
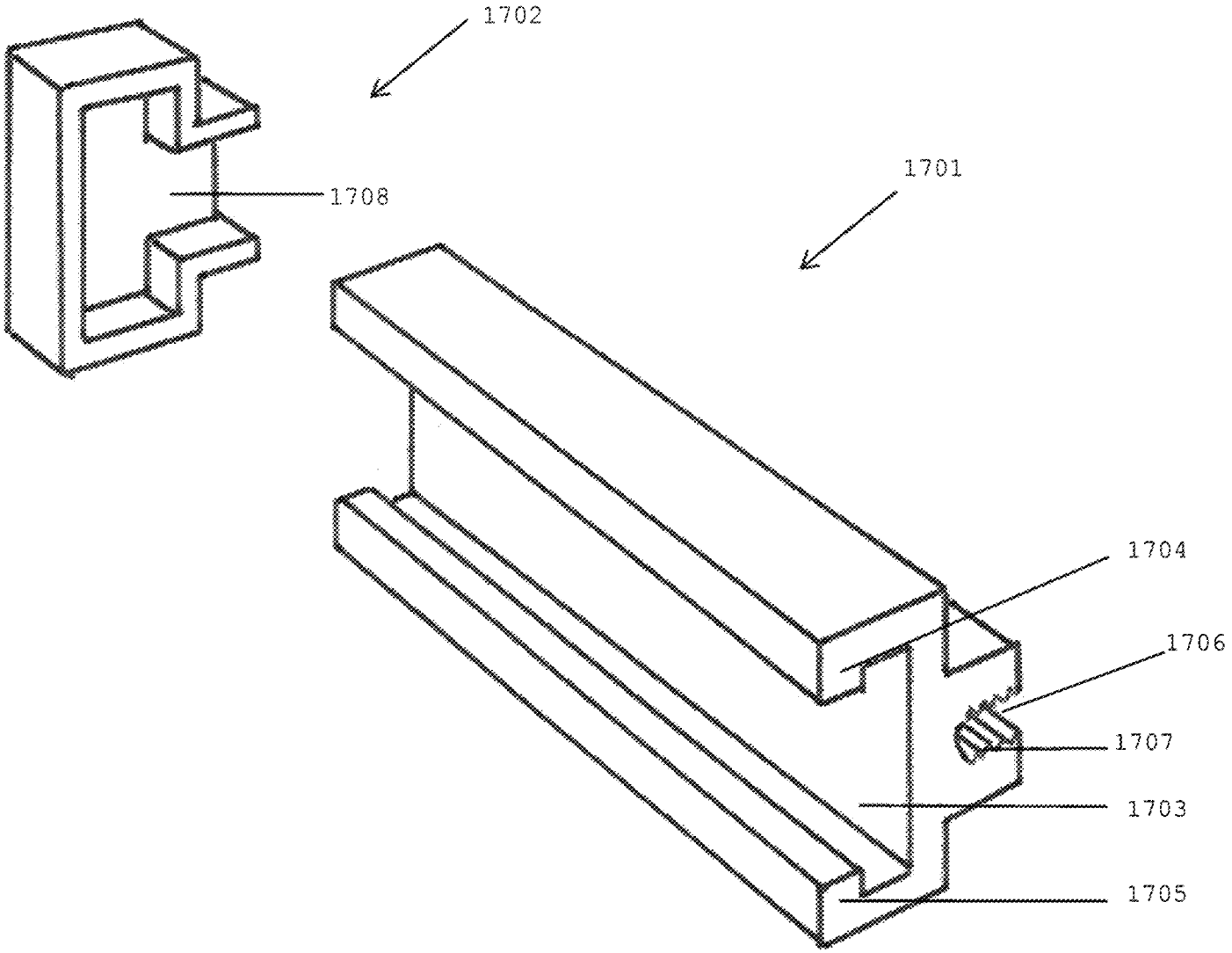
FIG. 17 is a perspective view of a tile holder with an end cap according to a twelfth embodiment of the present invention.

FIG. 17 shows a perspective view of a tile holder 1701 according to a twelfth embodiment of the present invention. FIG. 17 shows a tile holder 1701 with an end cap 1702. The tile holder 1701 comprises a channel 1703, formed from a bottom side, top side, a first lip 1704 and a second lip 1705. The tile holder portion forming the channel 1703 is shaped and sized to hold a rigid tile 102 (see FIG. 1). The tile holder 1701 further comprises a second channel 1706 for attaching to a storage device. The tile holder portion forming the second channel 1706 may optionally have barbs 1707 to provide a more secure grip on the storage device.

The end cap 1702 comprises an end cap channel 1708 that is closed at one end. The open end of the end cap channel 1708 is shaped and sized to fit over the tile holder 1701. Alternatively, the end cap 1702 may be used with other embodiments of the present invention, such as the tile holder 101 (see FIG. 1), the tile holder 301 (see FIG. 3), or the tile holder 501 (see FIG. 5). Accordingly, the end cap channel 1708 would be shaped and sized to fit over those embodiments.

Figure 18:
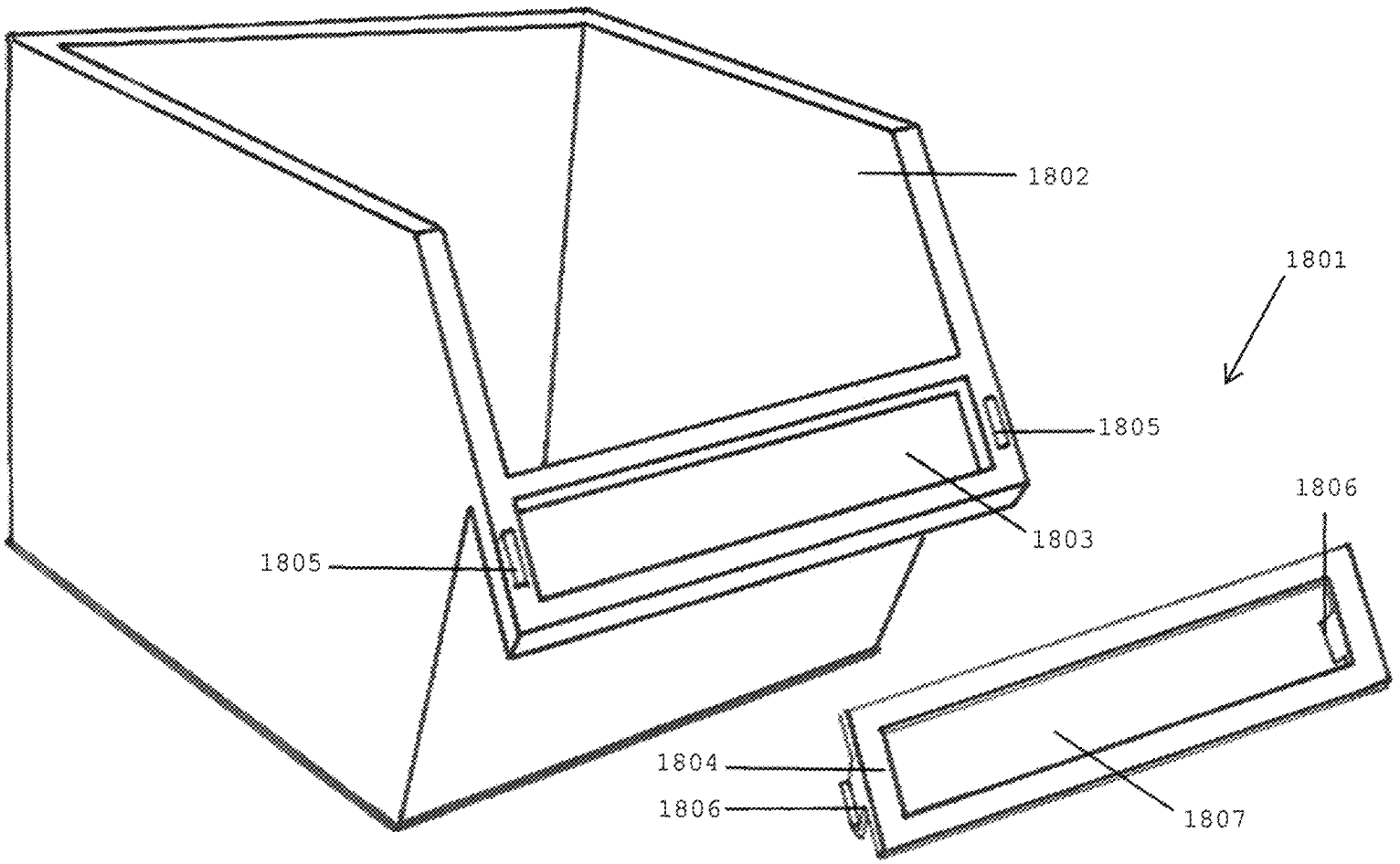
FIG. 18 is a perspective view of a tile holder mounted to a storage tote according to a thirteenth embodiment of the present invention.

FIG. 18 shows a perspective view of an integrated tile holder 1801 according to a thirteenth embodiment of the present invention. The integrated tile holder 1801 is integrated in a storage device, such as the storage tote 1802 shown in FIG. 18. In an alternate embodiment, the integrated tile 1801 holder may be mounted on the storage device, such as a storage tote 1802.

The integrated tile holder 1801 comprises a channel 1803 and a face plate 1804. The tile holder portion forming the channel 1803 is bordered by at least one aperture 1805 and the face plate 1804 is bordered by at least one projection 1806. The apertures 1805 and the projections 1806 are placed to line up with each other when the face plate 1804 is placed within the channel 1803. One aperture 1805 and one projection 1806 collectively form a snap fit lock. In a preferred embodiment, the aperture 1805 and the projection 1806 may be repeatedly engaged and released without sacrificing the ability of the snap fit lock mechanism to securely join the integrated tile holder 1801 to the storage tote 1802.

The face plate 1804 further comprises an opening 1807. The face plate 1804 and the tile holder portion forming the channel 1803 are preferably shaped and sized to keep the rigid tiles 102 within the integrated tile holder 1801. Specifically, the face plate 1804 and the channel 1803 operate together to prevent the rigid tiles 102 from falling through the opening 1807. The opening 1807 may be covered with a transparent or a translucent material to expose one face of each rigid tile 102. Alternatively, the opening 1807 may be uncovered.

The rigid tiles 102 are placed within the channel 1803 and held securely in place by the face plate 1804, when the snap fit lock is engaged. In an alternate embodiment, the rigid tiles 102 may be placed within the face plate 1804 and held securely in place by the channel 1803.

Figure 19:
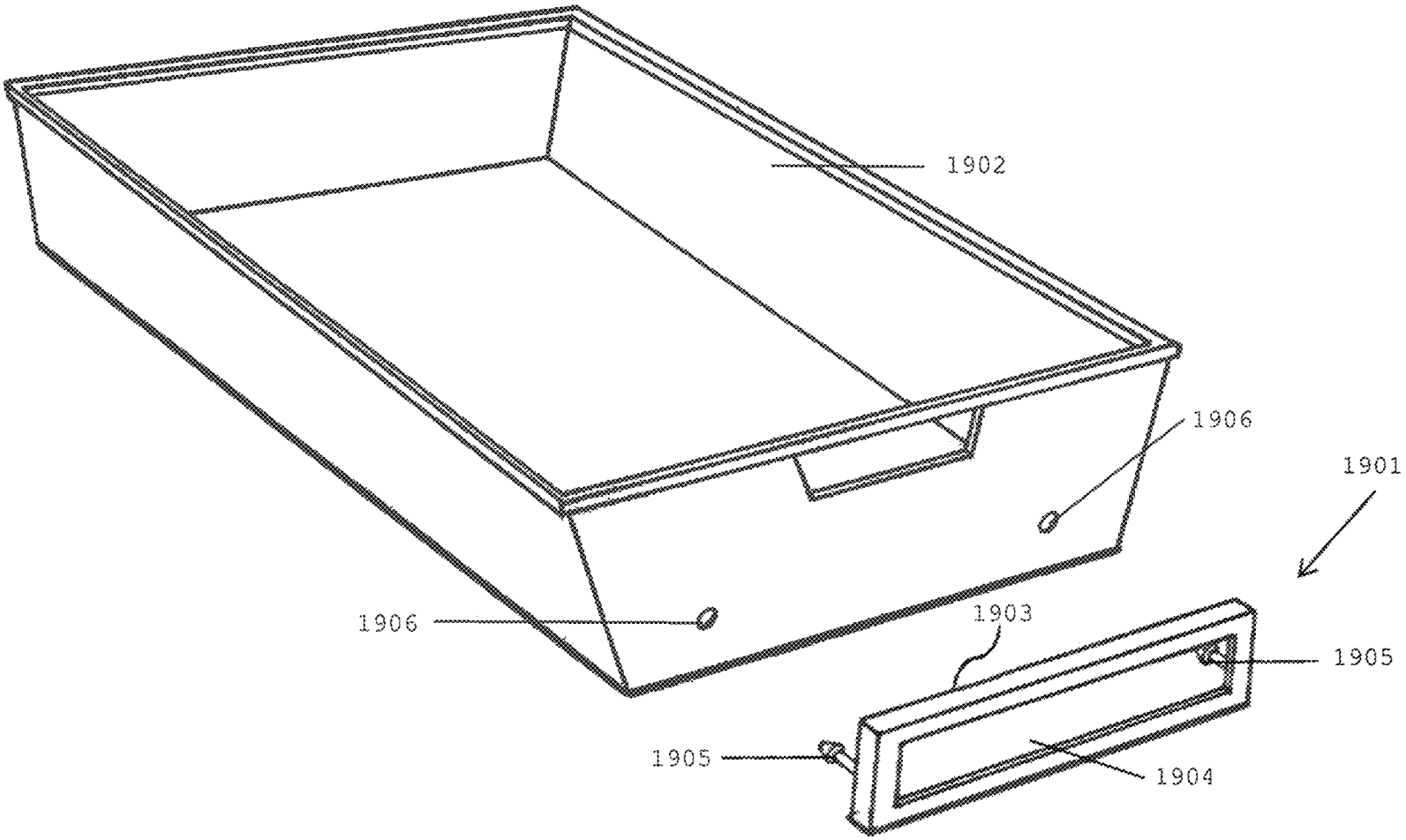
FIG. 19 is a perspective view of a tile holder mounted to a storage tote according to a fourteenth embodiment of the present invention.

FIG. 19 shows a perspective view of a tile holder 1901 according to a fourteenth embodiment. Similarly to FIG. 18, the tile holder 1901 is for mounting on a storage device, such as a storage tote 1902. In a preferred embodiment, the tile holder 1901 if suited for retro-fitting a metal mesh storage tote with the tile holder 1901.

The tile holder 1901 is a face plate that comprises a channel 1903, an opening 1904 and at least one projection 1905. The tile holder portion forming the channel 1903 and the opening 1904 are shaped and sized to simultaneously receive and display at least one rigid tile 102. The channel 1903 is not visible in FIG. 19; however, a skilled artisan would understand that the channel 1903 may be configured in a similar manner to other embodiments. Specifically, the rigid tiles 102 are supported by a lower side of the channel 1903. The rigid tiles 102 may be further supported by the back wall, which is comprised of the storage tote 1902 when the tile holder 1901 is attached. The opening 1904 may be covered with a transparent or a translucent material to expose one face of each rigid tile 102. Alternatively, the opening 1904 may be uncovered.

The projections 1905 are configured with a lip or step that is made of a flexible material such that the projection 1905 may contract to fit through holes 1906 in the storage device, such as a storage tote 1902. The holes 1906 may be added to the storage tote 1902 or may already be present in the metal or plastic mesh of the storage tote 1902. In a preferred embodiment, the projections 1905 may be repeatedly engaged and released without sacrificing the ability of the lock mechanism to securely join the tile holder 1901 to the storage tote 1902.

Figure 20:
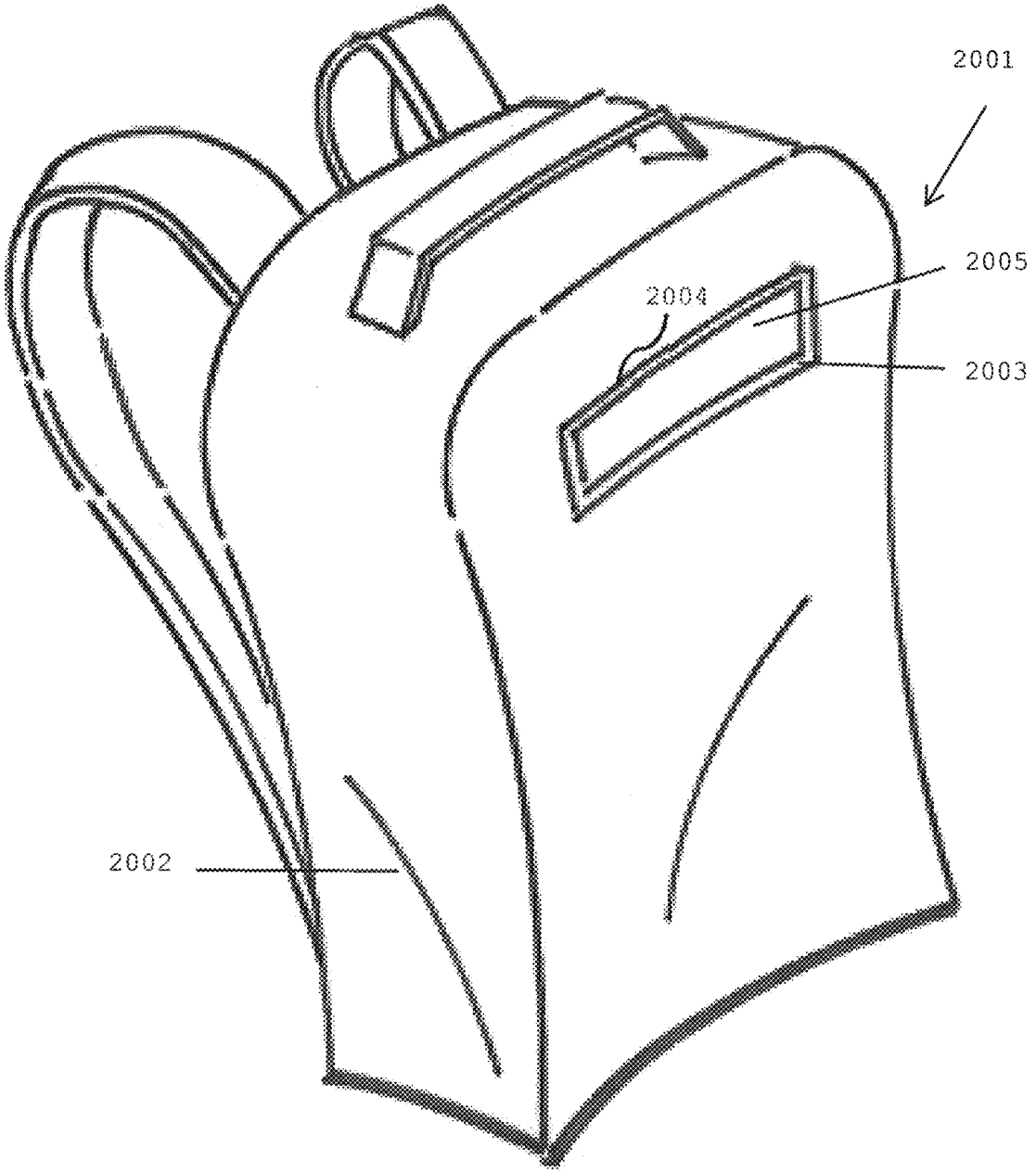
FIG. 20 is a perspective view of a tile holder according to a fifteenth embodiment of the present invention, mounted on or integrated into the front of a backpack.

FIG. 20 shows a perspective view of an integrated tile holder 2001 according to a fifteenth embodiment of the present invention. The integrated tile holder 2001 is for use with a cloth or flexible material based storage device, such as a backpack 2002.

The integrated tile holder 2001 is a flexible frame 2003 that comprises a channel 2004 and an opening 2005. The portion of the tile holder forming the channel 2004 and the opening 2005 are shaped and sized to simultaneously receive and display at least one rigid tile 102. The channel 2004 is not visible in FIG. 20; however, a skilled artisan would understand that the channel 2004 may be configured in a similar manner to other embodiments. The tile holder portion forming the channel 2004 may be integrated into the flexible frame 2003 or into the backpack 2002 or other suitable storage device.

The flexible frame 2003 may be securely fastened to the backpack 2002 or other suitable storage device on up to three (3) sides of the flexible frame 2003. The flexible frame 2003 may be fastened using any suitable fastening means, such as glue, stitches, contact cement, tape, etc. At least one side of the flexible frame 2003 (i.e., at least the fourth non-securely attached side plus any of the other three sides) is attached by a reusable fastening means, such as hook and loops (for example, VELCRO™), snaps, buttons, zipper, etc. The rigid tiles 102 are inserted into the channel 2004 through the at least one side of the flexible frame 2003 that is fastened with the reusable fastening means.

The flexible frame 2003 may be made of a flexible material, such as rubber or plastic, such that the integrated tile holder 2001 does not impede the movement of the storage device, such as the backpack 2002. The opening 2005 may be covered with a transparent or translucent material or be uncovered.

Figure 21:
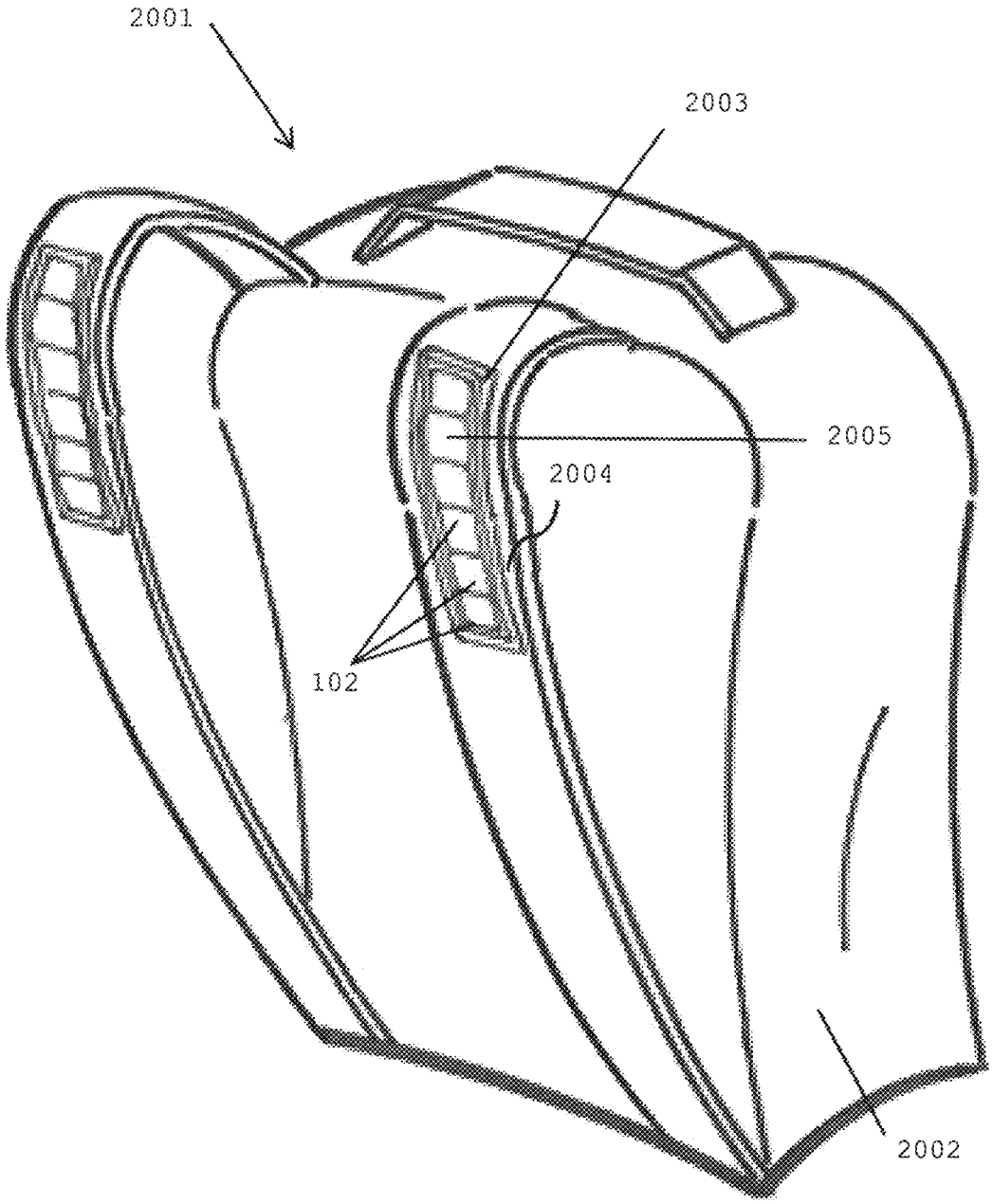
FIG. 21 is a perspective view of a tile holder according to the fifteenth embodiment, mounted on or integrated into backpack straps.

FIG. 21 shows another perspective view of the integrated tile holder 2001 according to the fifteenth embodiment in another configuration. The integrated tile holder 2001 is shown mounted on the strap of the backpack 2002. As shown in FIG. 21, the rigid tiles 102 are inserted into the integrated tile holder 2001 and are visible through the opening 2005.

Figure 22:
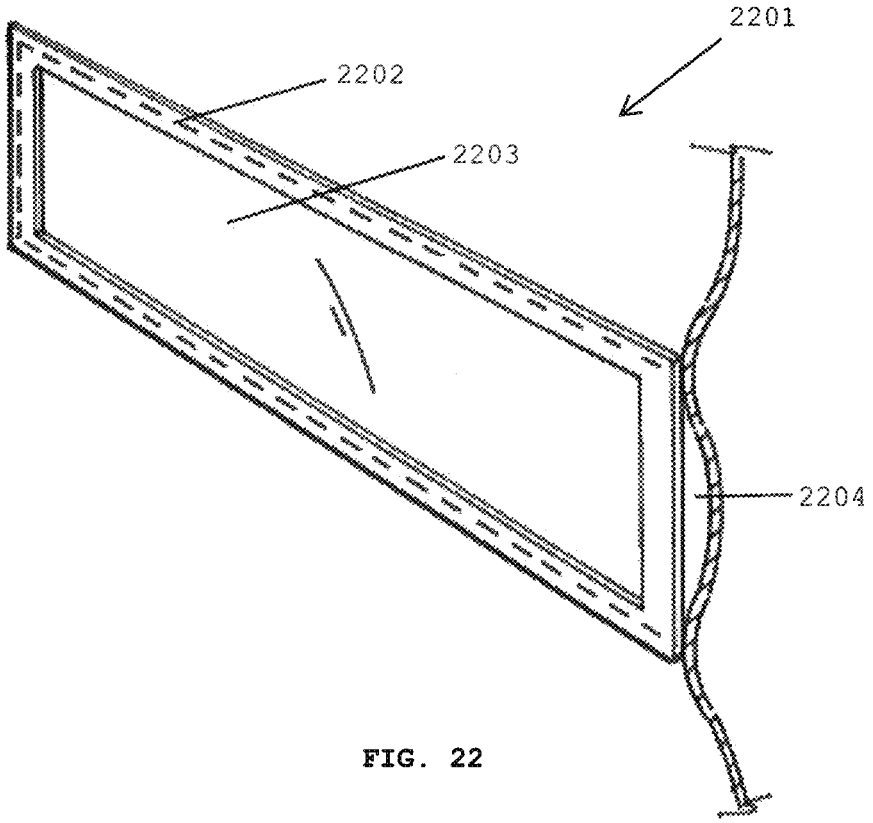
FIG. 22 is a perspective view of an integrated tile holder according to a sixteenth embodiment of the present invention.

FIG. 22 shows a perspective view of an integrated tile holder 2201 according to a sixteenth embodiment of the present invention. The integrated tile holder 2201 is for use with a cloth or flexible material based storage device, such as a cloth bag, backpack, suitcase, purse, laundry basket, etc. The integrated tile holder 2201 is comprised of a flexible frame 2202, a window 2203 and a slot 2204. The flexible frame 2202 and the window 2203 are sized and shaped to accept at least one rigid tile 102. The rigid tiles 102 are supported by the lower side of the frame 2202 and the storage device that the integrated tile holder 2201 is fastened to.

The flexible frame 2202 is securely fastened to the storage device on three (3) sides by any suitable fastening means, such as glue, stitches, contact cement, tape, etc. The fourth side of the flexible frame 2202 that is not securely fastened comprises a slot 2204 that is attached to the storage device by a reusable fastening means. Accordingly, the rigid tiles 102 may be inserted into the integrated tile holder 2201 through the slot 2204.

The flexible frame 2202 may be made of any flexible or semi-flexible material such as rubber or plastic. Similarly, the opening 2203 may be made of any flexible and clear material, such as plastic.

Figure 23:
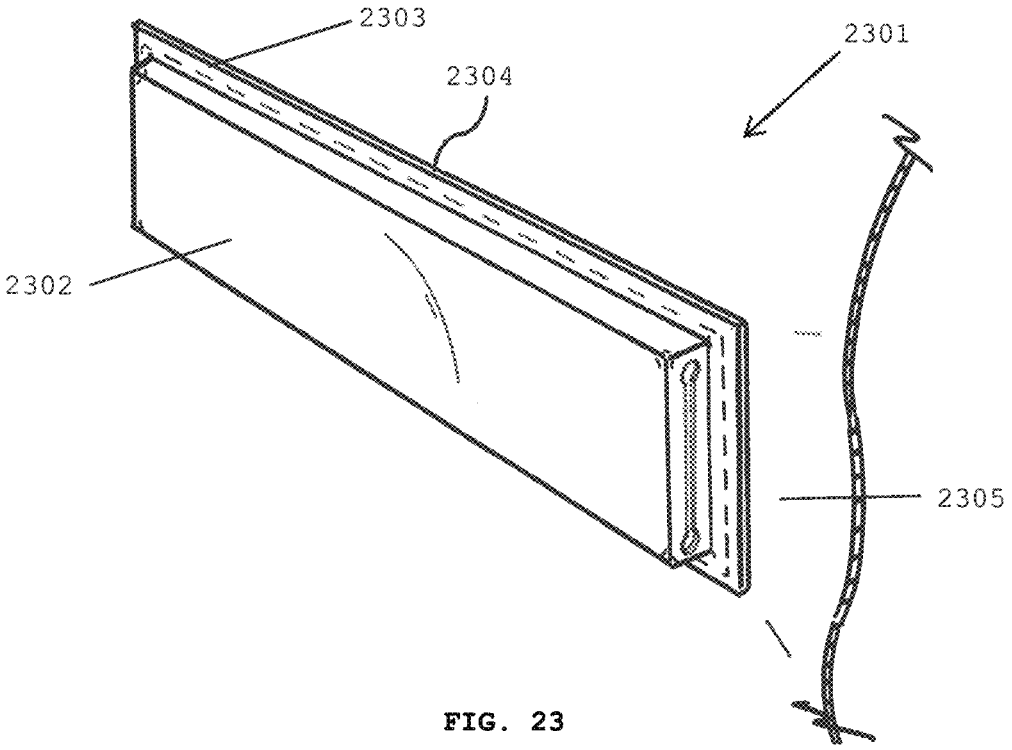
FIG. 23 is a perspective view of an integrated tile holder according to a seventeenth embodiment of the present invention.

FIG. 23 shows a perspective view of an integrated tile holder 2301 according to a seventeenth embodiment of the present invention. Similar to FIGS. 20 to 22, the integrated tile holder 2301 is for use with a cloth or flexible material based storage device. The integrated tile holder 2301 comprises a channel 2302, a frame 2303, a window 2304 and a slot 2305. The tile holder portion forming the channel 2302 is shaped and sized to hold the rigid tiles 102 that are visible through the window 2304. The rigid tiles 102 are supported by a lower side and a back side of the channel 2302.

Similar to the integrated tile holder 2201 shown in FIG. 22, the frame 2303 is securely fastened to the storage device on three (3) sides by any suitable fastening means. Furthermore, the slot 2305 is attached to the storage device by a reusable fastening means. Accordingly, the rigid tiles 102 are inserted into the integrated tile holder 2301 through the slot 2305.

The tile holder portion forming the channel 2302 and the frame 2303 may be integrated as one part that is molded or thermally formed. Alternatively, the tile holder portion forming the channel 2302 and the frame 2303 may form two separate pieces that are securely fastened to each other with a suitable fastening means. The tile holder portion forming the channel 2302 and the frame 2303 may be made from any material, rigid or flexible, that would support the rigid tiles 102.

Figure 24:
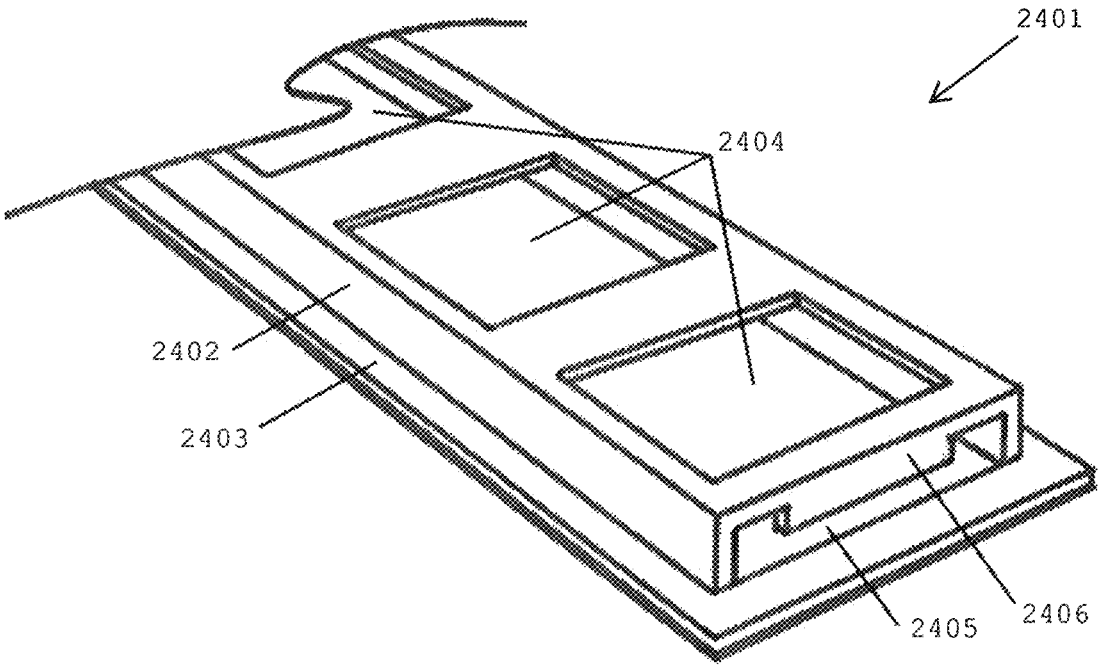
FIG. 24 is a perspective view of a tile holder according to an eighteenth embodiment of the present invention.

FIG. 24 shows a perspective view of an integrated tile holder 2401 according to an eighteenth embodiment of the present invention. Similar to FIGS. 20 to 23, the integrated tile holder 2401 is for use with a cloth or flexible material based storage device. The integrated tile holder 2401 comprises a channel 2402, a flexible frame 2403, at least one individual window 2404 and a flexible slot 2405.

The channel 2402 runs the entire length of the integrated tile holder 2401. The tile holder portion forming the channel 2402 is shaped and sized to receive rigid tiles 102 through the slot 2405. The channel 2402 has a first end, a second end, an upper side and a lower side. The front of the channel 2402 is defined by the individual windows 2404 and the back of the channel 2402 is defined by the flexible frame 2403. The rigid tiles 102 are supported by the lower side of the channel 2402 and may be further supported by leaning against the flexible frame 2403 or the individual window 2404.

The flexible frame 2403 may be made of any flexible or semi-flexible material. The flexible frame 2403 may be securely or removably fastened to the storage device using any suitable secure fastening means or reusable fastening means, respectively.

The individual windows 2404 may be covered with a transparent or translucent material or may be uncovered. The individual windows 2404 are configured such that the letter, number or pattern on the rigid tile 102, when inserted, is visible. In a preferred embodiment, the individual windows 2404 are configured such that the outer perimeter of each individual window 2404 is smaller than the outer perimeter of the rigid tile 102.

The slot 2405 is configured with a slot tab 2406 to facilitate the insertion and removal of rigid tiles 102. The slot tab 2406 is made of a flexible material, such as rubber or plastic, to allow the slot tab 2406 to be bend upwards to open the slot 2405 and insert the rigid tile 102. The flexible material allows the slot tab 2406 to recover back to the original position, as shown in this FIG. 24.

Figure 25:
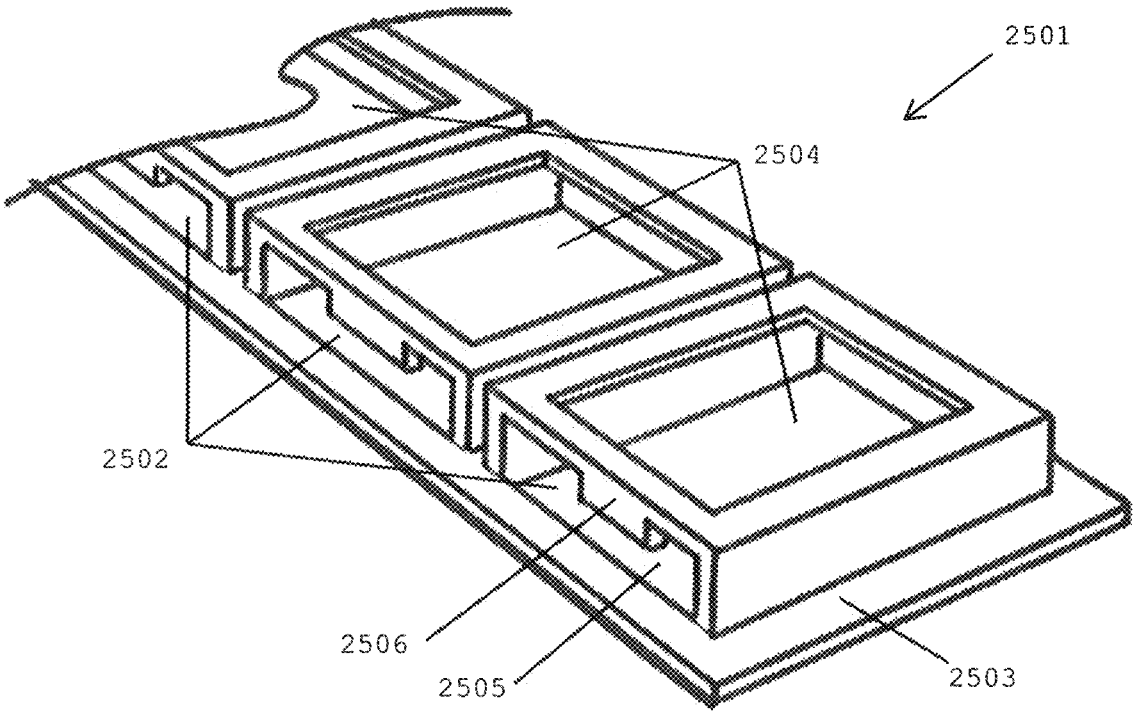
FIG. 25 is a perspective view of a tile holder according to a nineteenth embodiment of the present invention.

FIG. 25 shows a perspective view of an integrated tile holder 2501 according to a nineteenth embodiment of the present invention. The integrated tile holder 2501 is similar to the integrated tile holder 2401, the principle difference being that the integrated tile holder 2501 provides a single channel 2502 for each rigid tile 102. Each single channel 2502 is defined by a first side, a second side, the flexible frame 2503 as a back side, an individual window 2504 as a front side, a lower side and an individual slot 2505 as an upper side. Each of the individual slots 2505 has an individual slot tab 2506. Accordingly, the integrated tile holder 2501 allows for the easy insertion and removal of one rigid tile 102 at a time.

Figure 26:
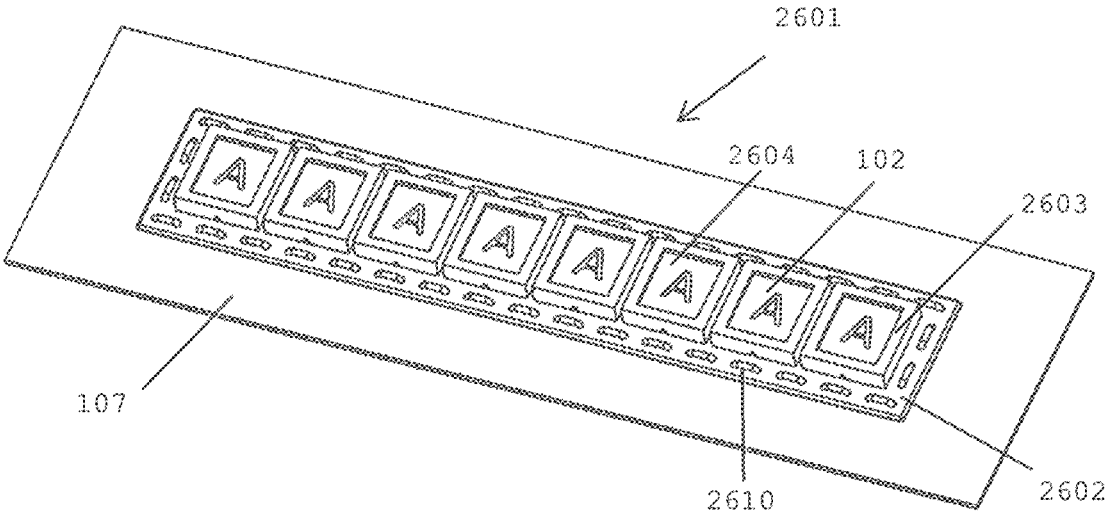
FIG. 26 is a perspective view of a tile holder according to a twentieth embodiment of the present invention.

FIG. 26 shows a perspective view of a flexible tile holder 2601 according to a twentieth embodiment of the present invention. The flexible tile holder 2601 is similar to the integrated tile holder 2501, in that the flexible tile holder 2601 also provides a single channel for each rigid tile 102. Each of the plurality of channels is defined by a back side 2602, the frame 2603, and a front side with an individual window 2604 (i.e., an opening). One side of the frame 2603 is an individual slot (not shown). Each of the individual slots has an individual slot tab (not shown). Accordingly, the flexible tile holder 2601 allows for the easy insertion and removal of one rigid tile 102 at a time.

As can be seen, the tile holder 2601 is fastened to the storage device 107 via fastening means 2610, such as glue, stitches, contact cement, tape, or any other suitable fastening means.

Figure 27:
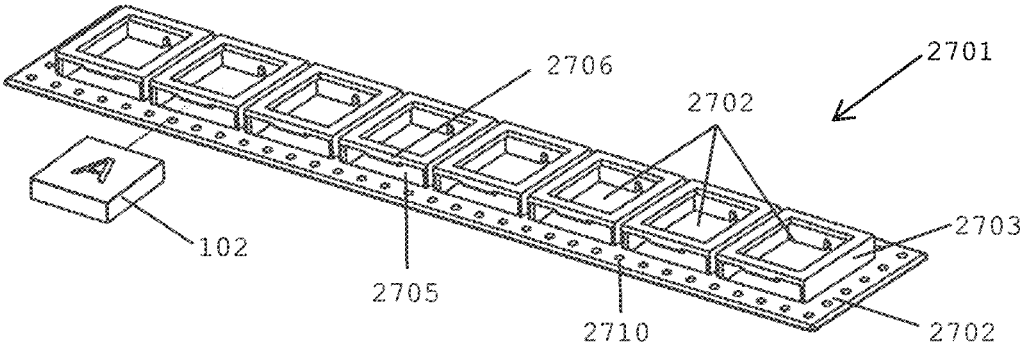
FIG. 27 is a perspective view of a tile holder according to a twenty-first embodiment of the present invention with a rigid tile.
Figure 28:
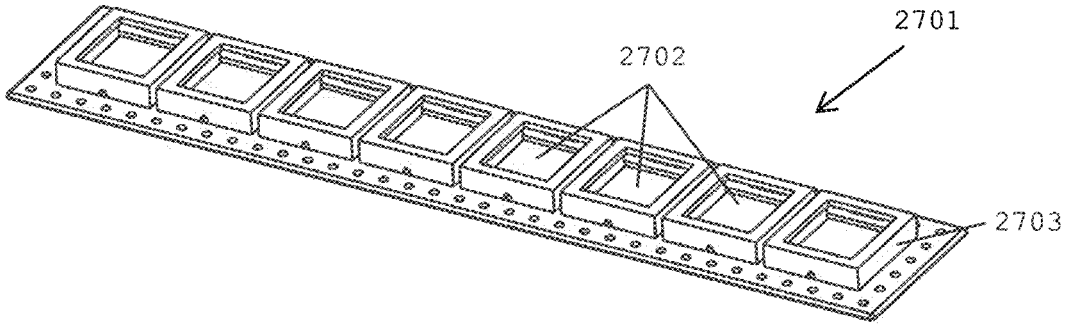
FIG. 28 is another perspective view of a tile holder according to a twenty-first embodiment of the present invention.

FIGS. 27 and 28 show a front and rear perspective view, respectively, of a flexible tile holder 2701 according to a twenty-first embodiment of the present invention. The flexible tile holder 2701 is similar to the integrated tile holder 2601, the principle difference being the fastening means 2710.

The flexible tile holder 2701 may be made of flexible material that can be fastened to a fabric, plastic, wood, or metal storage device.

Each of the plurality of channels 2702 is defined by a back side 2702, the frame 2703, and a front side with an individual window 2704 (i.e., an opening).

As can be seen, the fourth side comprises an individual slot 2705 with an individual slot tab 2706. The slot 2705 is configured with a slot tab 2706 to facilitate the insertion and removal of rigid tiles 102 into channel 2702. The slot tab 2706 may be made of a flexible material, such as rubber or plastic, to allow the slot tab 2706 to be bend upwards to open the slot 2705 and insert the rigid tile 102. The flexible material allows the slot tab 2706 to recover back to the original position, as shown in FIG. 27. Alternatively, the slot may have a hinged slot tab or other suitable means of opening the slot to insert a rigid tile 102 and closing the slot to retain the rigid tile 102 in the channel 2702.

Figure 29:
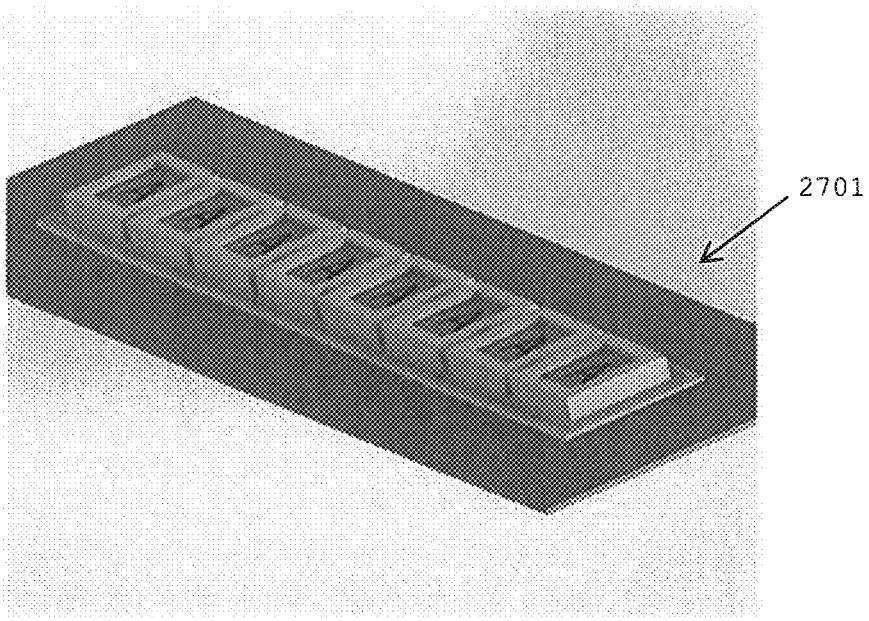
FIG. 29 is another perspective view of a tile holder according to a twenty-first embodiment of the present invention.

FIG. 29 shows another perspective view of the flexible tile holder 2701.

A person understanding this invention may now conceive of alternative structures and embodiments or variations of the above, all of which are intended to fall within the scope of the invention as defined in the claims that follow.

The invention claimed is:

1. A tile holder comprising:

a face plate comprising:

a front side with at least one opening, said at least one opening being for displaying at least one rigid tile and said front side being for keeping said at least one rigid tile within said tile holder; and a frame around an outer perimeter of said front side, said frame being for supporting said at least one rigid tile; and a spacer block for coupling to said face plate;

wherein said tile holder is for labelling a storage device and wherein said face plate and said spacer block are configured to secure said at least one rigid tile within said tile holder, such that said at least one rigid tile is manually insertable and removable from said tile holder.

2. The tile holder according to claim 1, wherein said tile holder is mountable on to said storage device.

3. The tile holder according to claim 1, wherein said at least one opening is uncovered or covered with a transparent material.

4. The tile holder according to claim 2, wherein said tile holder is mountable to said storage device with said spacer block placed between said face plate and said storage device.

5. The tile holder according to claim 4, wherein said spacer block has a first face and a second face, said first face having at least one channel for supporting at least a portion of said at least one rigid tile.

6. The tile holder according to claim 5, wherein said spacer block is reversible such that said spacer block is capable of being coupled to said face plate with said first face being adjacent to said at least one opening or said second face being adjacent to said at least one opening.

* * * * *